US012065801B2

(12) United States Patent
Zhou

(10) Patent No.: US 12,065,801 B2
(45) Date of Patent: Aug. 20, 2024

(54) CONCRETE VARIABLE CROSS-SECTION PREFABRICATED SQUARE PILE

(71) Applicant: Zhaodi Zhou, Zhejiang (CN)

(72) Inventor: Zhaodi Zhou, Zhejiang (CN)

( * ) Notice: Subject to any disclaimer, the term of this patent is extended or adjusted under 35 U.S.C. 154(b) by 276 days.

(21) Appl. No.: 17/639,882

(22) PCT Filed: May 20, 2020

(86) PCT No.: PCT/CN2020/091175

§ 371 (c)(1),
(2) Date: Mar. 2, 2022

(87) PCT Pub. No.: WO2021/042764

PCT Pub. Date: Mar. 11, 2021

(65) Prior Publication Data

US 2022/0341117 A1 Oct. 27, 2022

(30) Foreign Application Priority Data

Sep. 4, 2019 (CN) ..... 201921464635.1
May 6, 2020 (CN) ..... 202010371564.1

(51) Int. Cl.
*E02D 5/30* (2006.01)
*E02D 5/48* (2006.01)

(52) U.S. Cl.
CPC ..... *E02D 5/48* (2013.01); *E02D 5/30* (2013.01); *E02D 2200/1628* (2013.01); *E02D 2300/002* (2013.01)

(58) Field of Classification Search
CPC .. E02D 5/48; E02D 5/526; E02D 5/30; E02D 2200/1628; E02D 2300/002
See application file for complete search history.

(56) References Cited

U.S. PATENT DOCUMENTS 1,792,333 A * 2/1931 Takechi ..... B43L 13/004 405/232
3,593,532 A 7/1971 Grazel
(Continued)

FOREIGN PATENT DOCUMENTS

CN 102071677 A 5/2011
CN 202767059 U 3/2013
(Continued)

OTHER PUBLICATIONS

Extended European Search Report issued is EP application No. 20860285.4, dated Sep. 11, 2023; 8 pages.
(Continued)

*Primary Examiner* — Benjamin F Fiorello
(74) *Attorney, Agent, or Firm* — Schwabe, Williamson & Wyatt, P.C.

(57) ABSTRACT

A concrete variable cross-section prefabricated square pile comprises pile bodies of large cross-section sections and small cross-section sections alternately arranged along a longitudinal direction. Lateral transition surfaces are formed between side surfaces of the large cross-section sections and adjacent small cross-section sections; at least part of the lateral transition surfaces have a front edge and/or a rear edge that are offset from a vertical direction in a lateral projection, and a vertical projection of an intersection line between the lateral transition surface and a first horizontal plane is located outside a vertical projection of an intersection line between the lateral transition surface and a second horizontal plane; the first horizontal plane is a horizontal plane located above in any two horizontal planes, and the second horizontal plane is a horizontal plane located below in any two horizontal planes.

20 Claims, 26 Drawing Sheets

(56) References Cited

U.S. PATENT DOCUMENTS

| | | | | |
|---|---|---|---|---|
| 3,720,068 | A * | 3/1973 | De Rosa | E02D 5/64 405/251 |
| 4,836,717 | A * | 6/1989 | Landaeus | E02D 5/523 403/294 |
| 6,079,907 | A * | 6/2000 | Valero Ruiz | E02D 29/0233 405/259.1 |
| 6,672,015 | B2 * | 1/2004 | Cognon | C04B 28/02 405/36 |
| 10,161,096 | B2 * | 12/2018 | Masse | E02D 5/60 |
| 10,577,771 | B2 * | 3/2020 | Jullienne | E02D 27/02 |
| 2019/0153692 | A1 * | 5/2019 | Han | E02D 5/56 |

FOREIGN PATENT DOCUMENTS

| | | | |
|---|---|---|---|
| CN | 103132546 | A | 6/2013 |
| CN | 103628470 | A | 3/2014 |
| CN | 204059347 | U | 12/2014 |
| CN | 104358254 | A | 2/2015 |
| CN | 104895068 | A | 9/2015 |
| CN | 204738291 | U | 11/2015 |
| CN | 204780878 | U | 11/2015 |
| CN | 204780880 | U | 11/2015 |
| CN | 105926615 | A | 9/2016 |
| CN | 106284329 | A | 1/2017 |
| CN | 206529768 | U | 9/2017 |
| CN | 107700480 | A | 2/2018 |
| CN | 208346805 | U | 1/2019 |
| GB | 409753 | | 5/1934 |
| JP | S6375218 | A | 4/1988 |
| JP | 2002348859 | A | 12/2002 |
| JP | 2003336254 | A | 11/2003 |
| JP | 2004124491 | A | 4/2004 |
| JP | 2011017248 | A | 1/2011 |
| NL | 9500229 | A | 9/1996 |

OTHER PUBLICATIONS

International Search Report and Written Opinion including English translation for PCT/CN2020/091175, dated Aug. 18, 2020; 10 pages.

Examination Report No. 1 issued in Australian Application No. 2020341600 dated May 31, 2023; 7 pages.

Shangguan, "Reinforcement Engineering Calculation Methods and Examples" Golden Shield Publishing House, Dec. 31, 2018; 4 pages, including English translation.

The State Intellectual Property Office of People's Republic of China: First Office Action issued in Chinese Application No. 202010371564.1 on Feb. 21, 2022; 13 pages, including English translation.

* cited by examiner

CONCRETE VARIABLE CROSS-SECTION PREFABRICATED SQUARE PILE

This present disclosure is a national phase application under 35 U.S.C. § 371 of PCT international patent application PCT/CN2020/091175, filed on May 20, 2020, which designates the United States of America and claims priorities to the following two Chinese patent applications, both of which are incorporated herein by reference in their entireties, 1) Chinese Patent Application No. 201921464635.1, titled "VARIABLE CROSS-SECTION PREFABRICATED SQUARE PILE", filed with the China National Intellectual Property Administration on Sep. 4, 2019;
2) Chinese Patent Application No. 202010371564.1, titled "CONCRETE VARIABLE CROSS-SECTION PREFABRICATED SQUARE PILE", filed with the China National Intellectual Property Administration on May 6, 2020.

FIELD

The present disclosure relates to the technical field of prefabricated concrete piles, and in particular to a concrete variable cross-section prefabricated square pile.

BACKGROUND

Prefabricated concrete piles are prefabricated concrete elements with steel cages inside that are prefabricated at the factory.

Prefabricated piles include straight piles and variable cross-section piles. As the name implies, a cross-sectional shape and size of the straight pile are the same in the length direction, while a cross-sectional size and shape of the variable cross-sectional pile varies along the length direction of the pile. Compared with straight piles, variable cross-sectional piles have better uplift resistance and bearing performance, and are increasingly favored by the construction industry.

As disclosed in CN204738291U, a prefabricated concrete corrugate solid square pile includes a pile body with a square cross section, and further includes two large-section segments located at an upper end of the pile body and a lower end of the pile body, respectively, and an intermediate segment located between the two large-section segments. Small-section segments are provided at two ends of the intermediate segment, and a section area of the large-section segment is larger than a section area of the small-section segment; the large-section segment is transited to the small-section segment through an inclined plane. This kind of square pile has a variety of comprehensive properties including high vertical bearing capacity, strong horizontal shear resistance, good corrosion resistance and strong pullout resistance.

In practical use, in the process of checking the square pile before pile sinking, there is a certain probability that the intermediate segment of the variable cross-section pile is damaged in varying degrees, such as surface cracks, material breakage or peeling, etc. Once such phenomena are found, it is necessary to assess whether the damaged square piles can continue to be used normally. Generally, in order to ensure the engineering quality and construction progress, the square piles with serious defects are no longer used and can only be disposed of as construction waste.

For this kind of situation, for a long time, people in the art usually blame it on the concrete formula or manufacturing process. Some people think that it is caused by rough operation in the transfer process, and they have explored and improved in those directions.

However, after a long period of time, this problem has not been effectively solved.

SUMMARY

An object of the present disclosure is to provide a concrete variable cross-section prefabricated square pile, so as to reduce the phenomenon that the intermediate segment is prone to be damaged, reduce the damage rate of the variable cross-section prefabricated square pile, and make the product quality of the variable cross-section prefabricated square pile more stable and reliable, and meet a better actual use requirements.

To achieve the above object, a concrete variable cross-section prefabricated pile is provided according to the present disclosure, which includes a pile body with large-section segments and small-section segments being alternately arranged in a longitudinal direction, and a cross-section of the large-section segment and a cross section of the small-section segment are substantially rectangular; a lateral transition surface is formed between the side surfaces of the large-section segment and the adjacent small-section segment; at least a part of the lateral transition surfaces have front edges and/or rear edges deviated from the vertical direction in the lateral projection, and a vertical projection of the intersection line between the lateral transition surface and the first horizontal plane is located outside a vertical projection of the intersection line between the lateral transition surface and the second horizontal plane; a first horizontal plane is an upper horizontal plane among any two horizontal planes, and a second horizontal plane is a lower horizontal plane among any two horizontal planes, one or both side surfaces of the small-section segment are perpendicular to the bottom surface of the small-section segment or are inclined to the inside of the pile body from top to bottom at a set angle.

In an embodiment, a front edge and/or a rear edge of the lateral transition surface deviating from the vertical direction in lateral projection are an inclined edge or a curved edge.

In an embodiment, a front edge and a rear edge of the side surface of the large-section segment between the two ends are vertical edges, and a surface width thereof remains constant from top to bottom; or, the front edge and/or the rear edge of the side surface of the large-section segment between the two ends deviates from the vertical direction in the lateral projection, and its surface width increases or decreases from top to bottom.

In an embodiment, the lateral transition surface includes a first transition surface located at the front of the small-section segment and a second transition surface located at the rear of the small-section segment, a rear edge of the first transition surface is inclined or curved forward from top to bottom; and/or, and a front edge of the second transition surface is inclined or curved backward from top to bottom.

In an embodiment, the lateral transition surface includes a first transition surface located at the front of the small-section segment and a second transition surface located at the rear of the small-section segment, the front edge of the first transition surface is inclined or curved forward from top to bottom; and/or, the rear edge of the second transition surface is inclined or curved backward from top to bottom.

In an embodiment, the lateral transition surface is a plane, the front edge of the lateral transition surface is parallel to the rear edge of the lateral transition surface, and the surface width remains constant from top to bottom; or the lateral transition surface is a plane, the front edge and rear edge of the lateral transition surface are not parallel, and the surface width increases or decreases from top to bottom; or, the lateral transition surface is a curved surface, the front edge of the lateral transition surface is parallel to the rear edge of the lateral transition surface, and the surface width remains constant from top to bottom; or the lateral transition surface is a curved surface, the front edge and rear edge of the lateral transition surface are not parallel, and the surface width increases or decreases from top to bottom.

In an embodiment, the lateral transition surface is a concave curved surface, a convex curved surface or a twisted surface.

In an embodiment, the concave curved surface includes concave arc surface or concave conical surface, and the convex curved surface includes convex arc surface or convex conical surface.

In an embodiment, an extension line of the vertical projection of the intersection line between the lateral transition surface and the first horizontal plane intersects with an extension line of the vertical projection of the intersection line between the lateral transition surface and the second horizontal plane.

In an embodiment, the pile body has pile end faces, at least one pile end face has a groove and a plurality of connecting holes being arranged at intervals; the groove is configured to at least partially accommodate a storage block in which the viscous substance is stored, a depth of the groove is less than an initial height of the storage block; when the prefabricated square piles are butted together, the storage block is compressed so as to release a viscous substance to eliminate and/or fill the gaps at the end faces of the butted prefabricated square piles.

In an embodiment, a groove depth of the accommodating groove is greater than or equal to 1 mm, a groove width of the accommodating is greater than or equal to 1 mm, and the accommodating groove is more than 0.5 cm away from the connecting hole.

In an embodiment, a groove depth of the accommodating groove is 2 mm-20 mm.

In an embodiment, at least one of the grooves is circular or annular or rectangular or regular polygon and located at the center of the pile end face;

and/or, at least one of the grooves is annular and surrounds all connecting holes;

and/or, at least one of the grooves is annular and surrounds part of the connecting holes;

and/or, at least one of the grooves is annular and surrounds a single connecting hole.

In an embodiment, a rigid skeleton of the concrete variable cross-section prefabricated pile comprises: a main reinforcement skeleton with a plurality of main reinforcements being arranged at intervals and wound to form a reserved cavity, and a skeleton stirrup which ferrules the main reinforcement skeleton;

wherein the ends of the main reinforcement skeletons are bound with rigid mesh enclosures and/or rigid meshes to enhance the structural strength of the prefabricated piles, the ends of the main reinforcement skeleton are ferruled and fixed by auxiliary stirrups, and a winding interval of the auxiliary stirrups is less than or equal to a winding interval of the skeleton stirrups.

In an embodiment, the auxiliary stirrups form a stirrup dense zone, and a length of the stirrup dense zone is greater than a length of the large-section segment at the end; wherein a winding density of the stirrup dense zone is 1.5-3 times than a winding density of the non-dense zone.

In an embodiment, a plurality of C-shaped ferrules with openings facing the middle of the reserved cavity are further provided at the end faces of the main reinforcement skeleton.

In an embodiment, connecting nuts are connected to the end of the main reinforcement, and the auxiliary stirrup is connected and fixed with at least one of the connecting nuts.

In an embodiment, the C-shaped ferrules are arranged at intervals in the reserved cavities of the main reinforcement skeleton in sequence in the transverse or longitudinal direction; and/or the C-shaped ferrules are arranged crosswise in the reserved cavity of the main reinforcement skeleton; the C-shaped ferrules are fixedly connected with the auxiliary stirrup or/and the rigid mesh enclosure.

In an embodiment, the auxiliary stirrup and the rigid mesh enclosure are connected and fixed, and the rigid mesh enclosure is located inside the auxiliary stirrup;

or the rigid mesh enclosure includes a plurality of annular reinforcements arranged in sequence along the length of the main reinforcement skeleton at intervals and a plurality of axial reinforcements for connecting and fixing the annular reinforcements; wherein the axial reinforcements are parallel to the main reinforcements;

or the rigid meshes are arranged at the ends of the main reinforcement skeleton and arranged at intervals along the length direction of the reserved cavity.

In an embodiment, a length of the large-section segment at both ends of the pile body is greater than a length of the large-section segment in the middle part, the length of the large-section segment at both ends of the pile body is about 2 to 6 times the length of the large-section segment in the middle part;

and/or on the cross section of the small-section segment, a cross-sectional area of the small-section segment is S1, the sum of the cross-sectional areas of the steel bars is S2, wherein a ratio of S2 to S1 is at least 0.5% to 0.15%.

The above structural design is adopted according to the present disclosure. Compared with the conventional technology, the strength of the top surface and the lateral transition surface of the variable-section prefabricated square pile is enhanced, so that the compressive strength of the top surface of the variable-section prefabricated square pile is enhanced when being lifted, and the tensile force on the bottom surface is reduced, which further improves the bending resistance of the variable-section prefabricated square pile, reduces the generation of cracks during the lifting of the variable-section prefabricated square pile, improves the quality of the pile body, and reduces the rate of abandoned piles.

Moreover, since the front edge and/or the rear edge of the lateral transition surface are deviated from the vertical direction in the lateral projection, the area of the lateral transition surface is increased, and the lateral frictional resistance coefficient is changed, thereby improving the side friction resistance and compressive and pullout resistance of the variable cross-section prefabricated square pile body. Under the same working conditions, the specifications of prefabricated piles can be less, the cost performance can be improved, conforming to the national policy of energy conservation and emission reduction.

In addition, the demoulding efficiency of the variable cross-section prefabricated square pile can be improved, and the quality of the pile body can be improved. For example, in the demoulding process, the prestressed tensile force can be released, which may effectively prevent the die protrusion from being locked at the variable cross-section. It may further reduce the damage of the corrugate joints of the variable cross-section prefabricated square piles, reduce the labor consumption of manual repairing and damage, the integrity of the pile body is good, and the strength of the pile body is high.

Figure 1:
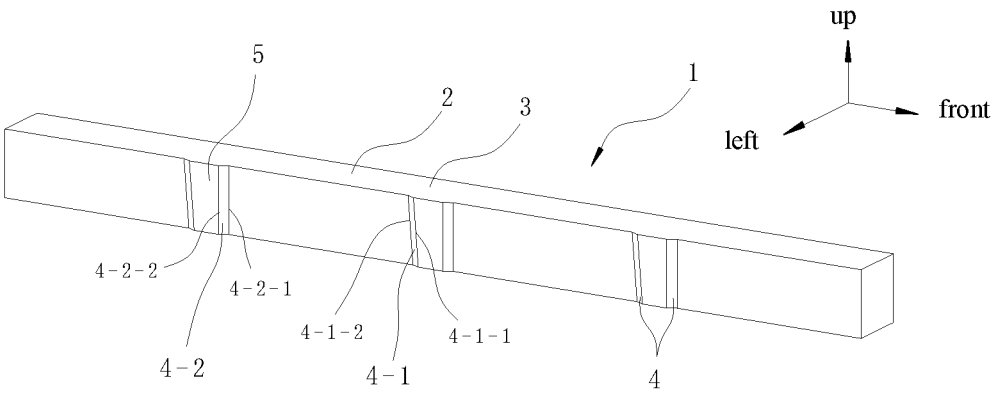
FIG. 1 is the structural schematic view of the variable cross-section prefabricated square pile disclosed in the first embodiment of the present disclosure.

Reference numerals in the drawings are listed as follows: 1 pile body, 2 small-section segment, 2-1 upper edge, 2-2 lower edge, 3 large-section segment, 3-1 upper edge, 3-2 lower edge, 4 lateral transition surface, 4-1 first transition surface, 4-1-1 front edge, 4-1-2 rear edge, 4-2 second transition surface, 4-2-1 front edge, 4-2-2 rear edge, 4-2-3 upper edge, 4-2-4 lower edge, 5 left convex portion, 6 right convex portion, 7 upper convex portion, 8 lower convex portion, 9 connecting hole, 10 storage block, 11 groove, 12 viscous substance, 13 rebar, 14 mechanical connection piece, 15 sealing ring, 16 concrete component, 17 pile end, 18 smooth transition portion, 19 pile end surface, 21 main reinforcement, 22 skeleton stirrup, 23 rigid mesh, 23-1 reinforcing stiffener, 24 auxiliary stirrup, 25 connecting nut, 26 rigid mesh enclosure, 26-1 ring reinforcement, 26-2 axial reinforcement, 27 C-type ferrule.

DETAILED DESCRIPTION OF THE EMBODIMENTS

In order to enable those skilled in the art to better understand the technical solutions of the present application, the present application will be further described in detail with reference to the drawings and specific embodiments.

In this specification, the terms "up, down, left, right, front, back" are established based on the positional relationship shown in the attached drawings, and the corresponding positional relationship may change according to the different attached drawings. Therefore, it cannot be understood as an absolute limitation of the scope of protection. Moreover, the relational terms such as "first" and "second" etc. are only used to distinguish one element from another having the same name and do not necessarily require or imply any such actual existence between those elements relationship or order.

The construction procedure of prefabricated piles mainly includes prefabrication, transportation, stacking and pile sinking. In each construction procedure, it is inevitable for prefabricated piles to be frequent lifted.

The existing lifting method is to set a hook on the top of the pile body, and use a hoisting equipment to lift the prefabricated pile. According to the length and mass of the prefabricated pile, it is more general to perform a two-point lifting with two hooks on the pile. When performing the two-point lifting, due to the combined action of lifting force and pile gravity, the top surface of pile body is above the bottom surface of pile body in the lifting direction, where the top surface of pile body is pressed and the bottom surface of pile body is pulled.

It is found by the inventor's research that because the concrete has a compressive strength far greater than the tensile strength and the pile body has a large gravity, the bottom surface of the pile body and the lateral transition surface are easily cracked due to the high tensile strength, which is one of the reasons for the damage to the pile body. Although the cross section of the existing variable cross-section pile may vary in the length direction, the cross sections in the height direction remain the same. Therefore, when the tensile strength of the variable cross-section pile is high, the bottom surface will be always damaged first, which leads to the scrapping of the whole pile.

Based on this research conclusion, the structure of the variable cross-section prefabricated square pile is further improved according to the present application, so as to improve or eliminate the above-mentioned technical problems existing in the variable cross-section prefabricated square pile to a certain extent.

Figure 2:
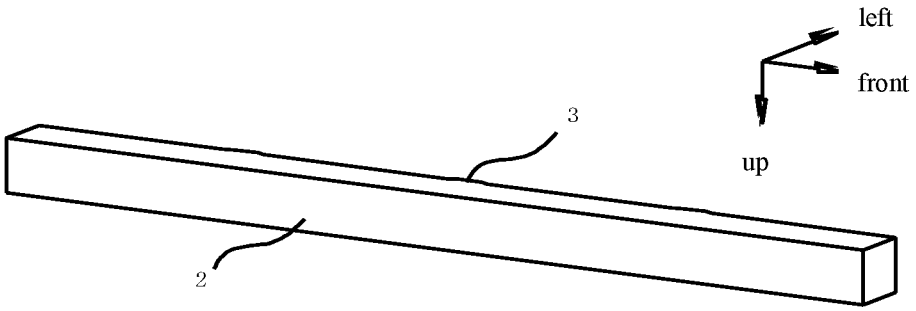
FIG. 2 is the structural schematic view of the variable cross-section prefabricated square pile shown in FIG. 1 from another perspective.
Figure 3:
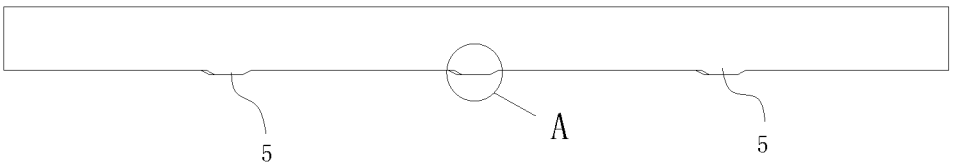
FIG. 3 is the top view of the variable cross-section prefabricated square pile shown in FIG. 1.
Figure 4:
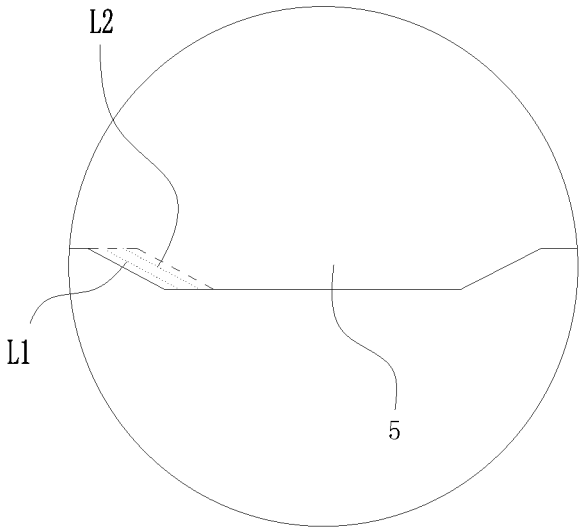
FIG. 4 is a partial enlarged view of part A in FIG. 3.

Referring to FIG. 1 to FIG. 4, FIG. 1 is the structural schematic view of the variable cross-section prefabricated square pile disclosed in the first embodiment of the present disclosure; FIG. 2 is the structural schematic view of the variable cross-section prefabricated square pile shown in FIG. 1 from another perspective; FIG. 3 is the top view of the variable cross-section prefabricated square pile shown in FIG. 1; and FIG. 4 is a partial enlarged view of part A in FIG. 3.

As shown in the Figure, in the first embodiment, in the concrete variable cross-section prefabricated pile provided by the present disclosure, the pile body 1 is alternately arranged with four small-section segments 2 and three large-section segments 3 along the front and rear directions, the cross sections of the large-section segment 3 and the small-section segment 2 are generally rectangular, the top surface, right side surface and bottom surface of the pile body are flat, and the left side surface is concave-convex surface. The left side of each large-section segment 3 protrudes outward relative to the small-section segment 2, and a lateral transition surface 4 is formed between each small-section segment 2 and the left convex portion 5.

Taking a small-section segment 2 in the middle as an example, the surfaces on both sides, that is, the left and right surfaces shown in the Figure are perpendicular to the bottom surface. The left and right side surfaces of the large-section segment 3 are also perpendicular to the bottom surface. The lateral transition surface 3 formed between the small-section segment 2 and the front large-section segment 3 is a first transition surface 4-1, and the lateral transition surface formed between the small-section segment 2 and the rear large-section segment 3 is a second transition surface 4-2.

The first transition surface 4-1 is an inclined plane, and its front edge 4-1-1 and rear edge 4-1-2 are straight edges, which are parallel to each other. The front edge 4-1-1 and the rear edge 4-1-2 are deviated from the vertical direction in lateral projection, and inclined forward at a certain angle from top to bottom. As can be seen from the top view, if the intersection line between any two horizontal planes and the first transition surface 4-1 is vertically projected, the vertical projection L1 of the intersection line between the first transition surface 4-1 and the first horizontal plane is located outside the vertical projection L2 of the intersection line between the first transition surface 4-1 and the second horizontal plane, where the first horizontal plane 4-1 is an upper horizontal plane among any two horizontal planes, and the second horizontal plane is a lower horizontal plane among any two horizontal planes.

The second transition surface 4-2 is an inclined plane, and its front edge 4-2-1 and rear edge 4-2-2 are straight edges, which are parallel to each other. The laterally projections of the front edge 4-2-1 and the rear edge 4-2-2 maintain in a vertical direction without being inclined forward or backward.

The variable cross-section prefabricated square pile with this structure may enhance the strength of the top surface and the lateral transition surface 4, so that the compressive strength of the top surface of the variable-section prefabricated square pile is enhanced when being lifted, and the tensile force on the bottom surface is reduced, which further improves the bending resistance of the variable-section prefabricated square pile, reduces the generation of cracks during the lifting of the variable-section prefabricated square pile, improves the quality of the pile body, and reduces the rate of abandoned piles.

Moreover, since the front edge 4-1-1 and the rear edge 4-1-2 of the first transition surface 4-1 in the lateral projection are deviated from the vertical direction, the area of the first transition surface 4-1 is increased, and the side friction coefficient is changed, thereby improving the side friction resistance and compressive and pullout resistance of the variable cross-section prefabricated square pile body. Under the same working conditions, the specifications of prefabricated piles can be less, the cost performance can be improved, conforming to the national policy of energy conservation and emission reduction.

In addition, the demoulding efficiency of the variable cross-section prefabricated square pile can be improved, and the quality of the pile body can be improved. For example, in the demoulding process, the prestress and the tensile force can be released, which can effectively prevent a protrusion of a die from being stuck at the variable cross-section. It may further reduce the damage of the corrugate joints of the variable cross-section prefabricated square piles, reduce the labor consumption of manual repairing for the damage, and the integrity of the pile body is good, and the strength of the pile body is high.

Figure 5:
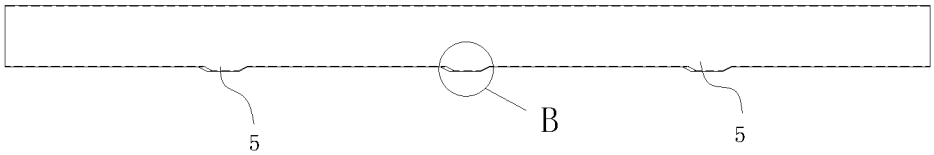
FIG. 5 is a top view of the variable cross-section prefabricated square pile disclosed in the second embodiment of the present disclosure.
Figure 6:
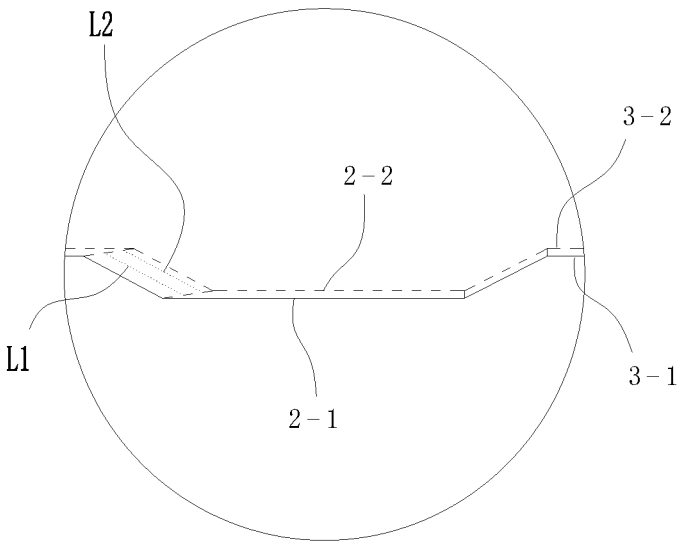
FIG. 6 is a partial enlarged view of part B in FIG. 5.

Referring to FIG. 5 and FIG. 6, FIG. 5 is a top view of the variable cross-section prefabricated square pile disclosed in the second embodiment of the present disclosure, and FIG. 6 is a partial enlarged view of part B in FIG. 5;

In this embodiment, the same reference numerals represent the same parts with those in the first embodiment, and the same descriptions to which are omitted.

As shown in the Figure, in the second embodiment, the left side surface and right side surface of the small-section segment 2 are not perpendicular to the bottom surface, and inclined to the inside of the pile body at a set angle from top to bottom instead. Similarly, the left side surface and right side surface of the large-section segment 3 are not perpendicular to the bottom surface, but inclined to the inside of the pile body at a set angle from top to bottom instead.

As such, in the top view, the upper edge 2-1 and the lower edge 2-2 (shown by dotted line) of the small-section segment 2 are no longer overlapped, and the vertical projection of the lower edge 2-2 is located inside the vertical projection of the upper edge 2-1. Similarly, the upper edge 3-1 and the lower edge 3-2 (shown by dotted lines) of the large-section segment 3 are no longer overlapped, and the vertical projection of the lower edge 3-2 is located inside the vertical projection of the upper edge 3-1.

Figure 7:
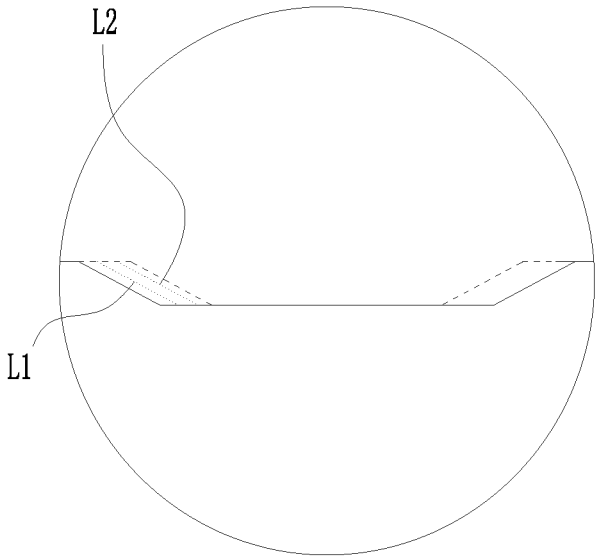
FIG. 7 is a partial enlarged view of the variable cross-section prefabricated square pile disclosed in the third embodiment of the present disclosure.
Figure 8:
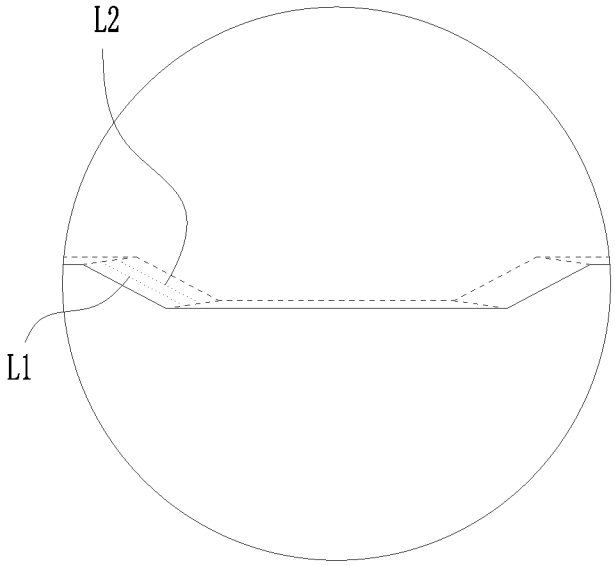
FIG. 8 is a partial enlarged view of the variable cross-section prefabricated square pile disclosed in the fourth embodiment of the present disclosure.

Two lateral transition surfaces 4 (see FIG. 7) described above, which are symmetrical front-back, can be formed on the same left convex portion 5 based on the first embodiment. Two lateral transition surfaces 4 (see FIG. 8) described above, which are symmetrical front-back, can also be formed on the same left convex portion 5 based on the second embodiment, so as to obtain a third, fourth and more embodiments.

Figure 9:
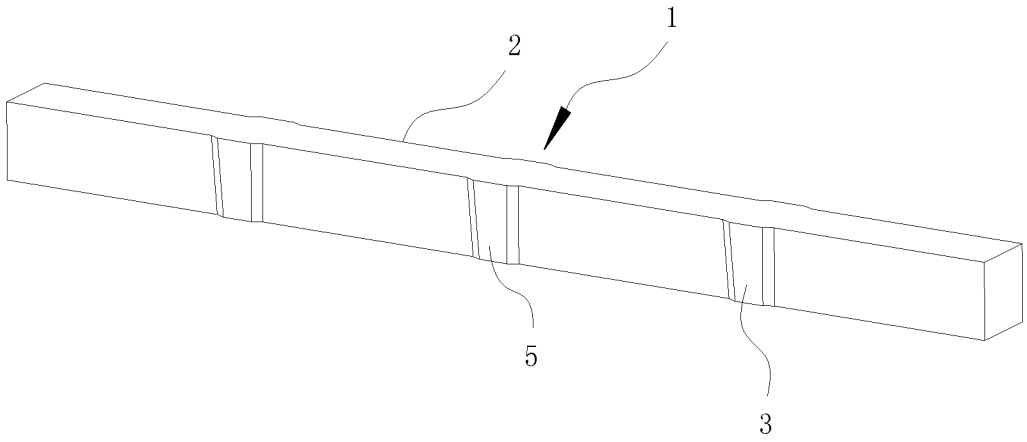
FIG. 9 is a structural schematic view of the variable cross-section prefabricated square pile disclosed in the fifth embodiment of the present disclosure.
Figure 10:
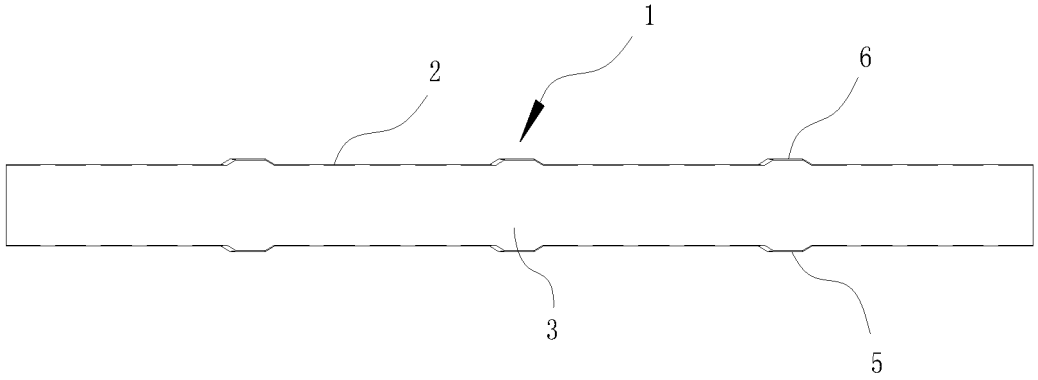
FIG. 10 is the top view of the variable cross-section prefabricated square pile shown in FIG. 9.

Referring to FIG. 9 and FIG. 10, FIG. 9 is the structural schematic view of the variable cross-section prefabricated square pile disclosed in the fifth embodiment of the present disclosure, and FIG. 10 is the top view of the variable cross-section prefabricated square pile shown in FIG. 9.

In this embodiment, the same reference numerals represent the same parts with those in the second embodiment, and the same descriptions to which are omitted.

As shown in the Figure, on the basis of the second embodiment, the right side of the pile body 1 is also provided with three spaced right convex portions 6 protruding from the pile body. The convex portion 5 on the left side of the pile body 1 is mirror-symmetrical with the convex portion 6 on the right side.

The left convex portion 5 and the right convex portion 6, which are mirror-symmetrical, enable the variable cross-section prefabricated square pile to be subjected to more uniform force as being driven into a soil mass, so as to keep the pile body vertically entering the soil mass.

Figure 11:
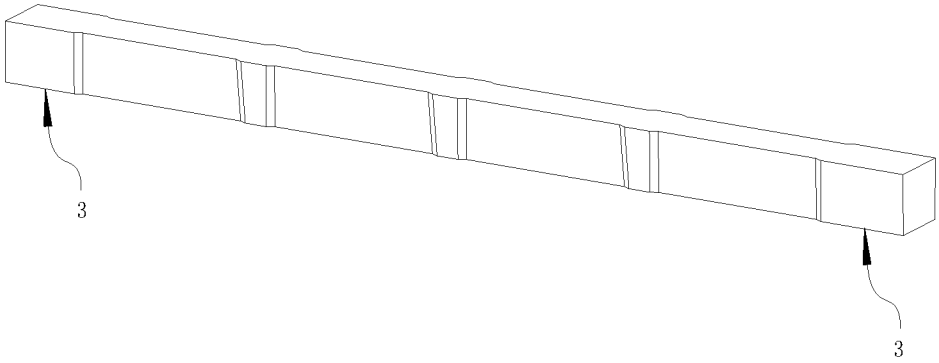
FIG. 11 is the structural schematic view of the variable cross-section prefabricated square pile disclosed in the sixth embodiment of the present disclosure.

Referring to FIG. 11, FIG. 11 is the structural schematic view of the variable cross-section prefabricated square pile disclosed in the sixth embodiment of the present disclosure.

In this embodiment, the same reference numerals represent the same parts with those in the third embodiment, and the same descriptions to which are omitted.

As shown in the Figure, on the basis of the third embodiment, a large-section segment 3 is provided at two ends of the pile body 1, and the cross-sections of the large-section segments 3 at the two ends are basically the same with the cross-sections of the large-section segment 3 in the middle. This structural design can effectively improve the pile end bearing capacity of the pile body and improve the impact resistance of the pile end, and it can compromise the pile end bearing capacity, pile pressing force and side friction resistance in an optimal situation.

Compared with the third embodiment, this embodiment can not only bear uniform force during pile driving and ensure vertical entry into the soil mass, but also effectively improve the pile end bearing capacity.

Figure 12:
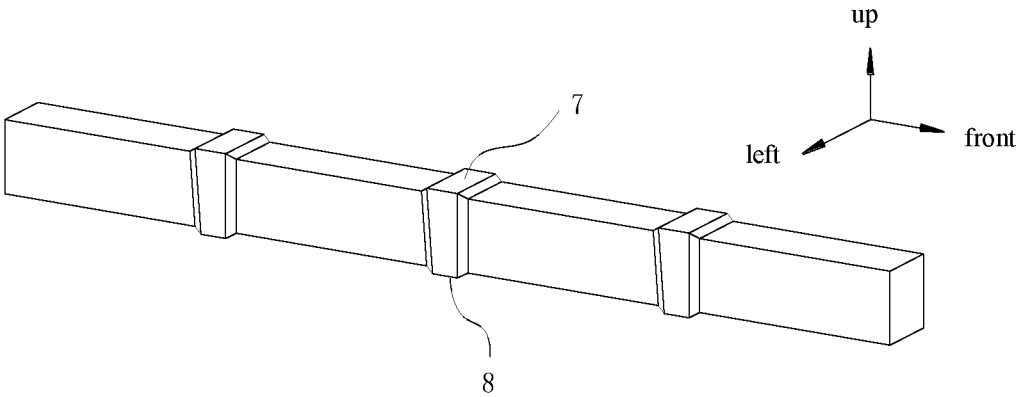
FIG. 12 is the structural schematic view of the variable cross-section prefabricated square pile disclosed in the seventh embodiment of the present disclosure.
Figure 13:
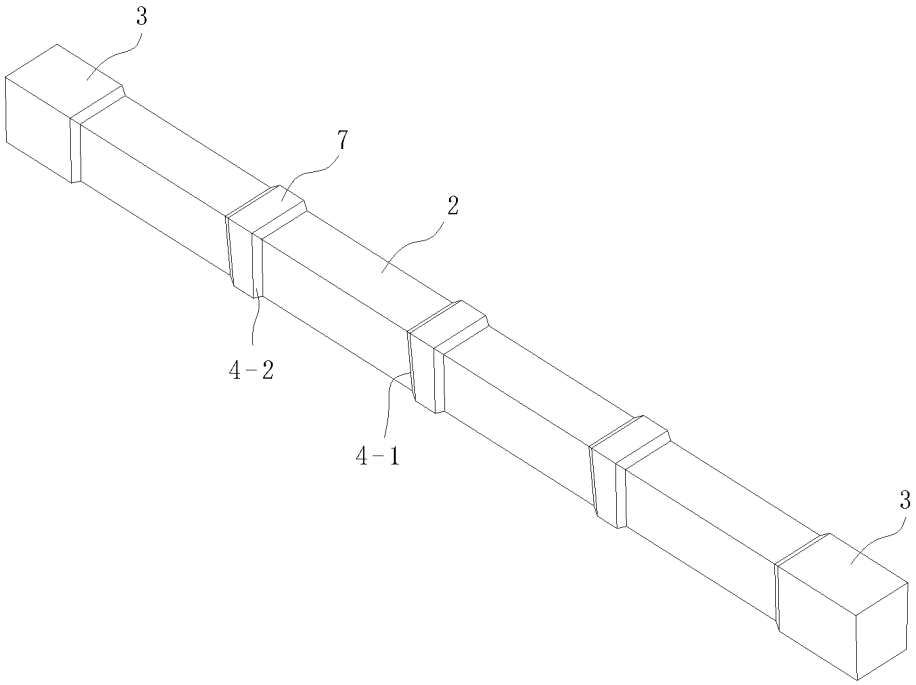
FIG. 13 is the structural schematic view of the variable cross-section prefabricated square pile disclosed in the eighth embodiment of the present disclosure.

Referring to FIG. 12, FIG. 12 is the structural schematic view of the variable cross-section prefabricated square pile disclosed in the seventh embodiment of the present disclosure.

In this embodiment, the same reference numerals represent the same parts with those in the third embodiment, and the same descriptions to which are omitted.

As shown in the Figure, on the basis of the third embodiment, three upper convex portions 7 protruding from the pile body is provided on the top surface of the pile body 1, and three lower convex portions 8 protruding from the pile body are provided on the bottom surface of the pile body 1.

Compared with the third embodiment, the variable cross-section prefabricated square pile of this embodiment are further provided with a upper convex portion 7 and a lower convex portion 8, which further improves the bending strength of the pile body. On the other hand, the contact area between the pile body and soil mass is further increased, which increases the side friction resistance. Furthermore, the left convex portion 5 and the right convex portion 6 are in uniform transition both with the lower convex portion 8 and the upper convex portion 7, which facilitates of manufacturing and has a compact structure and a good mechanical performance.

In this embodiment, the above structural design makes each convex portion form in a closed ring shape, which enhances the integrity of the variable cross-section prefabricated square pile and achieves an optimal bending performance of the pile body. The strength of the convex portion is enhanced in a certain extent, and the anti-crushing ability is further improved.

Figure 14:
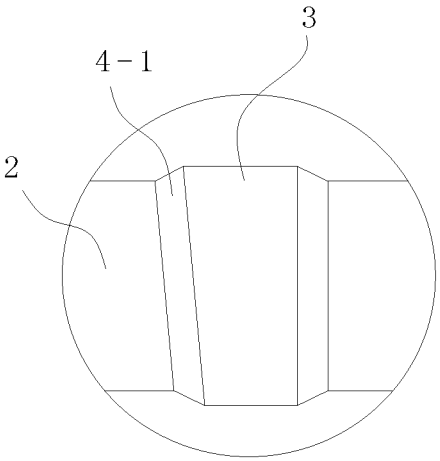
FIG. 14 is a partial enlarged view of FIG. 13.
Figure 15:
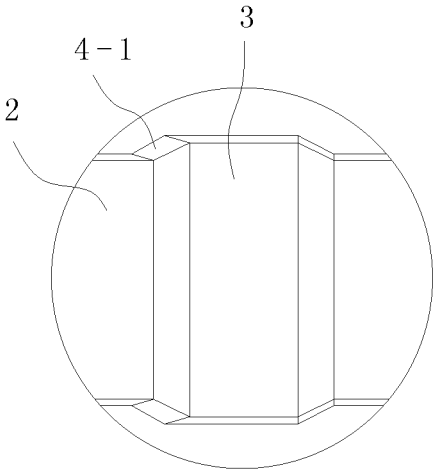
FIG. 15 is a bottom view of FIG. 14.
Figure 16:
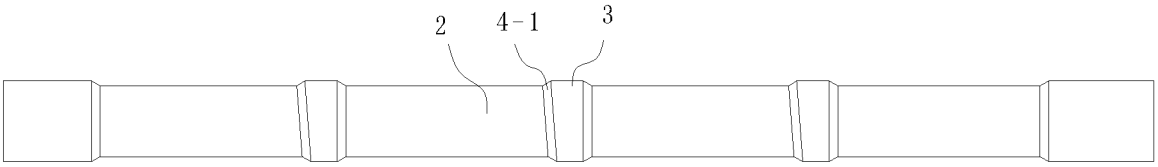
FIG. 16 is a side view of the variable cross-section prefabricated square pile shown in FIG. 13.

Referring to FIG. 13 to FIG. 16, FIG. 13 is the structural schematic view of the variable cross-section prefabricated square pile disclosed in the eighth embodiment of the present disclosure; FIG. 14 is a partial enlarged view of FIG. 13; FIG. 15 is a bottom view of FIG. 14; and FIG. 16 is a side view of the variable cross-section prefabricated square pile shown in FIG. 13.

In this embodiment, the same reference numerals represent the same parts with those in the seventh embodiment, and the same descriptions to which are omitted.

As shown in the Figure, on the basis of the seventh embodiment, large-section segments 3 are formed at two ends of the pile body 1, and the cross-sections of the large-section segments 3 at two ends are basically the same with the cross-sections of the large-section segment 3 in the middle. Compared with the small-section segment 2, the large-section segment 3 has a left convex portion 5, a right convex portion 6, an upper convex portion 7 and a lower convex portion 8 in the circumferential direction.

This structural design can effectively improve the pile end bearing capacity of the pile body and improve the impact resistance of the pile end, and it can compromise the pile end bearing capacity, pile pressing force and side friction resistance in an optimal situation.

The length of the large-section segment 3 at both ends of the pile body 1 is greater than the length of the large-section segment 3 in the middle part, the length of the large-section segments 3 at both ends of the pile body is approximately 2 to 6 times the length of the large-section segment 3 in the middle part, so as to improve the structural strength and impact resistance of the pile ends.

Compared with the seventh embodiment, this embodiment can not only be subject to a uniform force during pile driving and ensure vertical entry into the soil mass, but also effectively improve the pile end bearing capacity.

Figure 17:
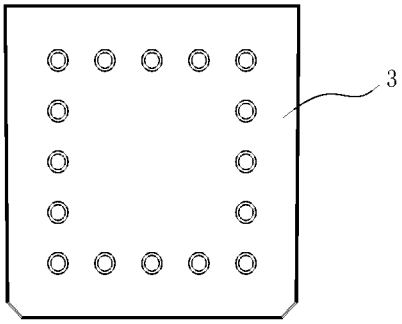
FIG. 17 is a schematic end view of the prefabricated square pile with variable cross-section shown in FIG. 13 with a chamfer at the bottom edge.
Figure 18:
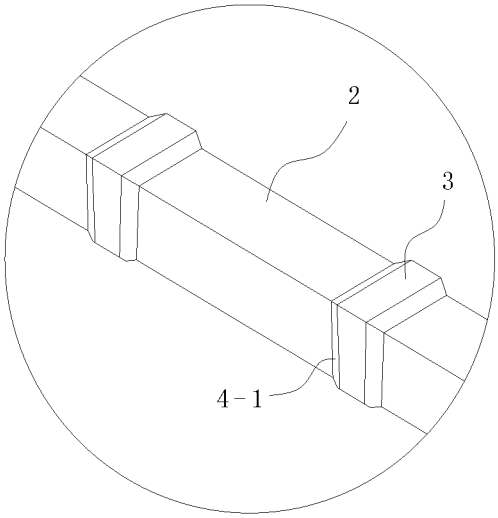
FIG. 18 is a partial structural schematic view of the variable cross-section prefabricated square pile shown in FIG. 13 with a chamfer at the bottom edge.
Figure 19:
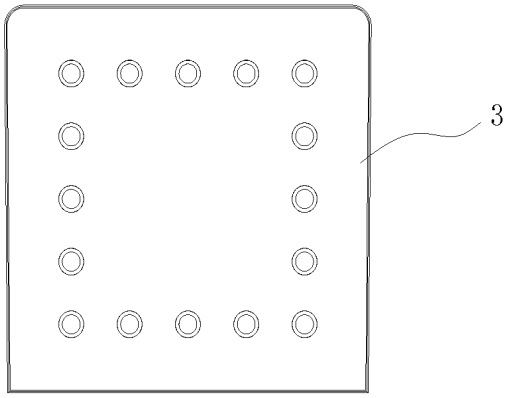
FIG. 19 is a schematic end view of the variable cross-section prefabricated square pile shown in FIG. 13 where the top edge is in a smooth transition.
Figure 20:
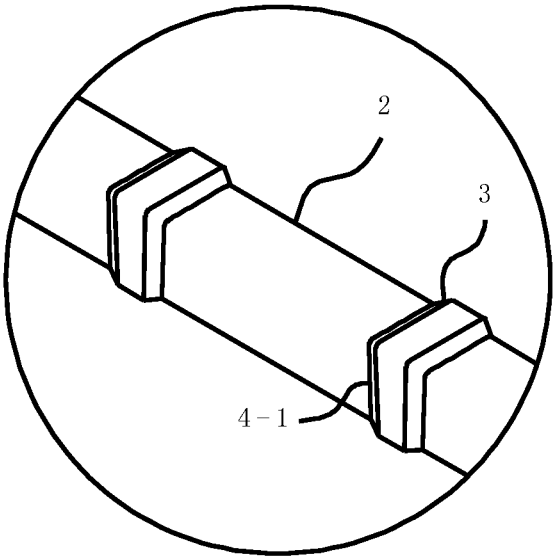
FIG. 20 is a partial structural schematic view of the variable cross-section prefabricated square pile shown in FIG. 13 where the bottom surface edge is in a smooth transition.
Figure 21:
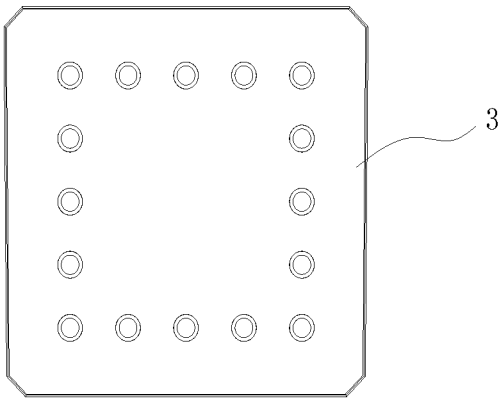
FIG. 21 is a schematic end view of the variable cross-section prefabricated square pile shown in FIG. 13 with chambers at the top and bottom edges.
Figure 22:
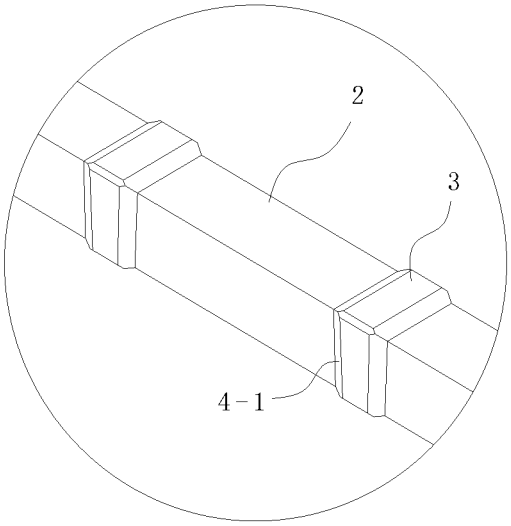
FIG. 22 is a partial structural schematic view of the variable cross-section prefabricated square pile shown in FIG. 13 with chamfers at the top and bottom edges.
Figure 23:
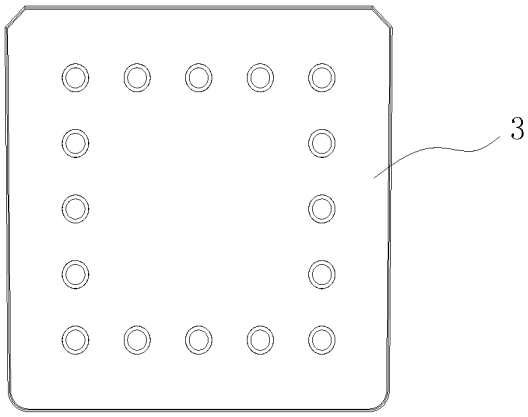
FIG. 23 is a schematic end view of the variable cross-section prefabricated square pile shown in FIG. 13 with a chamfer at the top edge and the bottom edge being in a smooth transition.
Figure 24:
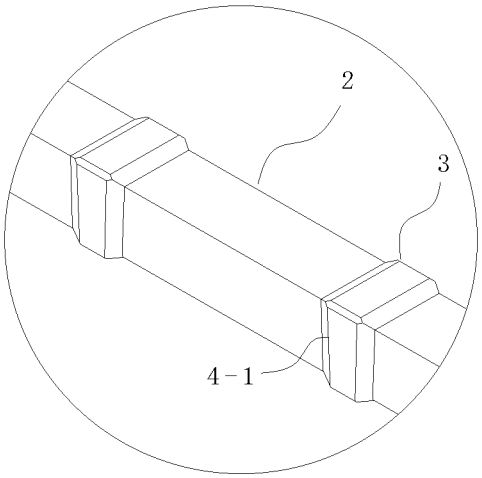
FIG. 24 is a partial structural schematic view of the variable cross-section prefabricated square pile shown in FIG. 13 with a chamfer at the top edge and the bottom edge being in a smooth transition.

Based on the eighth embodiment, more embodiments can be made by changing the shapes of the upper and lower edges of the large-section segment 3 of the pile body. For example, the bottom edge of the variable-section prefabricated square pile has beveled chamfers (see FIG. 17, FIG. 18), or the top edge of the variable-section prefabricated square pile has a smooth transition, that is, rounding chamfers (see FIG. 19 and FIG. 20), or the top and bottom edges of variable-section prefabricated square piles both have beveled chamfers (see FIG. 21, FIG. 22), or the top edge of the variable-section prefabricated square pile has beveled chamfers and the bottom edge has a smooth transition (see FIG. 23 and FIG. 24).

Figure 25:
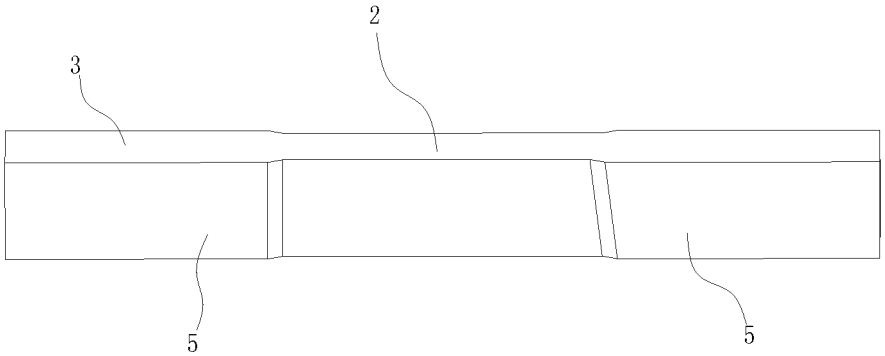
FIG. 25 is the structural schematic view of the variable cross-section prefabricated square pile disclosed in the ninth embodiment of the present disclosure.
Figure 26:
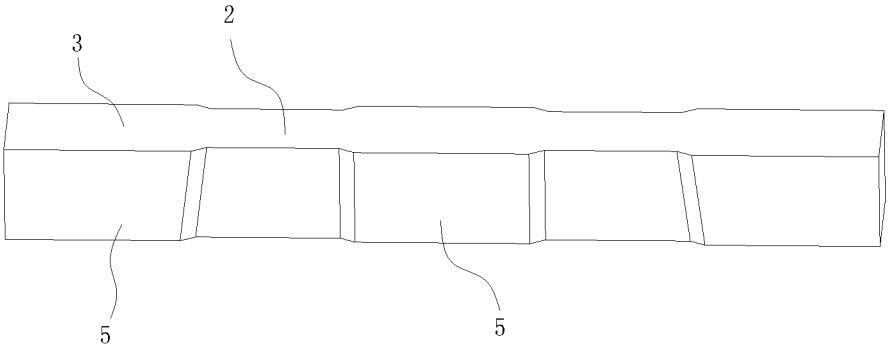
FIG. 26 is the structural schematic view of the variable cross-section prefabricated square pile disclosed in the tenth embodiment of the present disclosure.
Figure 27:
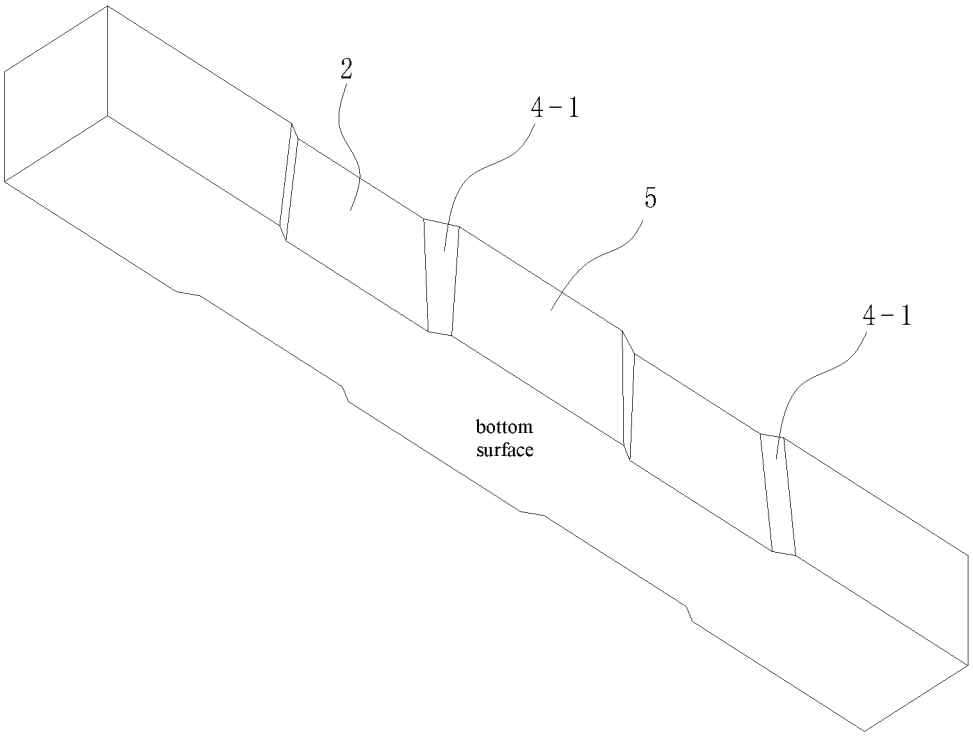
FIG. 27 is the structural schematic view of the variable cross-section prefabricated square pile disclosed in the eleventh embodiment of the present disclosure.

In addition, on the basis of the sixth embodiment shown in FIG. 11, the embodiment shown in FIG. 25 can be obtained in a case that the large-section segment 3 in the middle part is removed, only the large-section segments 3 at both ends are provided, and the length of the pile body is shortened. Or, only one large-section segment 3 located in the middle part is provided, so as to obtain the embodiment shown in FIG. 26. On the basis of FIG. 25 and FIG. 26, other embodiments are made by further providing the upper convex portion 7 and the lower convex portion 8 to the large-section segment 3. Although the lengths of the pile bodies 1 in these embodiments are short, they can be connected to each other by butting multiple of these so as to form a prefabricated pile with a longer size, thereby achieving substantially the same use effect with the other embodiments described above.

Figure 28:
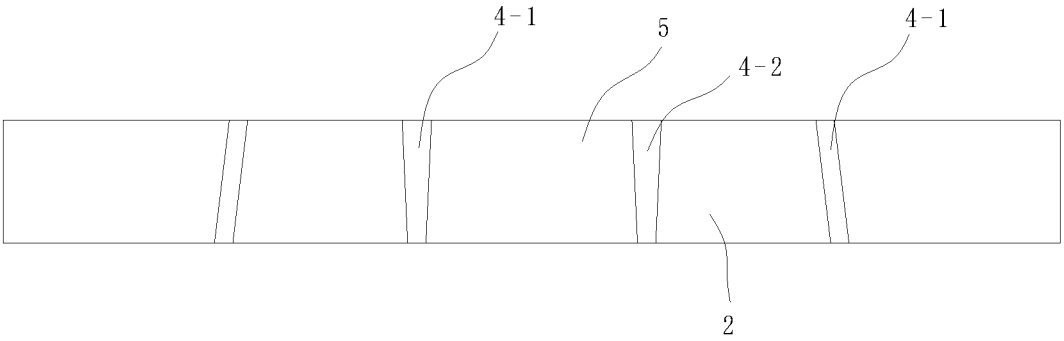
FIG. 28 is a side view of the variable cross-section prefabricated square pile shown in FIG. 27.
Figure 29:
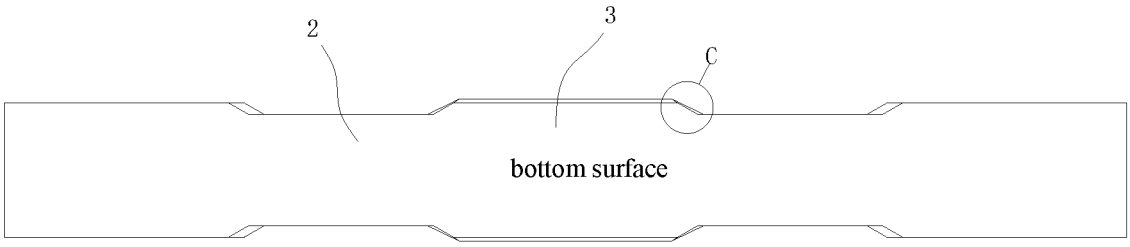
FIG. 29 is a bottom view of the variable cross-section prefabricated square pile shown in FIG. 27.
Figure 30:
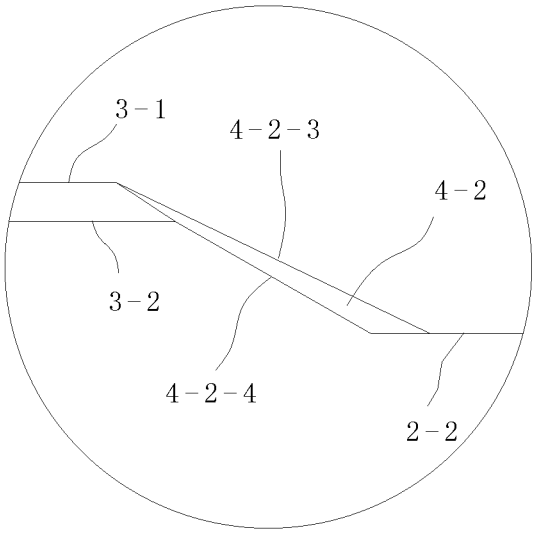
FIG. 30 is a partial enlarged view of part C in FIG. 29.

Referring to FIG. 27 to FIG. 30, FIG. 27 is the structural schematic view of the variable cross-section prefabricated square pile disclosed in the eleventh embodiment of the present disclosure; FIG. 28 is a side view of the variable cross-section prefabricated square pile shown in FIG. 27; FIG. 29 is a bottom view of the variable cross-section prefabricated square pile shown in FIG. 27; and FIG. 30 is a partial enlarged view of part C in FIG. 29.

In this embodiment, the same reference numerals represent the same parts with those in the eighth embodiment, and the same descriptions to which are omitted.

As shown in the Figure, on the basis of the eighth embodiment, the lateral transition surfaces 4 of two small-section segments 2 are symmetrical in the front-rear direction. The lateral transition surface 4 will be described below by taking a small-section segment 2 on the front side as an example.

This small-section segment 2 has a first transition surface 4-1 at the front and a second transition surface 4-2 at the rear, the front edge 4-1-1 and the rear edge 4-1-2 of the first transition surface 4-1 are parallel and inclined forward from top to bottom; the front edge 4-2-1 of the second transition surface 4-2 is inclined backward from top to bottom and the rear edge 4-2-2 of the second transition surface 4-2 is inclined forward from top to bottom. The front edge and the rear edge are not parallel, and the lateral projection of the front edge and the rear edge forms a trapezoidal waistline with being long in top and short in bottom.

It can be seen from the bottom view that the vertical projection of the upper edge 4-2-3 of the second transition surface 4-2 is located outside the vertical projection of the lower edge 4-2-4 of the second transition surface 4-2. If the intersection line between any two horizontal planes and the second transition surface 4-2 is projected vertically, the vertical projection of the intersection line between the second transition surface 4-2 and the first horizontal plane can be located outside the vertical projection of the intersection line between the second transition surface 4-2 and the second horizontal plane. The first horizontal plane is an upper horizontal plane among any two horizontal planes, and the second horizontal plane is a lower horizontal plane among any two horizontal planes. Furthermore, the extension line of the vertical projection of the intersection line between the second transition surface 4-2 and the first horizontal plane and the extension line of the vertical projection of the intersection line between the second transition surface 4-2 and the second horizontal plane are intersected at one point.

Figure 31:
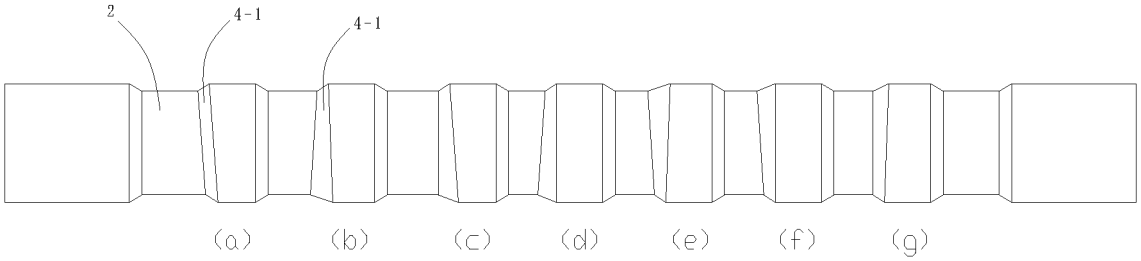
FIG. 31 is a schematic view of concentrated display of type (a)~(g) lateral transition surfaces formed on the pile body.

Referring to FIG. 31, FIG. 31 is a schematic view of concentrated display of type (a)~(g) lateral transition surfaces formed on the pile body.

As shown in the Figure, in other embodiments, the lateral transition surface 4 of the small-section segment 2 may have various forms.

The first transition surface 4-1 in the lateral transition surface 4 of type (a) shown in the Figure is a plane, the front edge 4-1-1 and rear edge 4-1-2 of which are parallel. Viewed from the side, the width between the front edge 4-1-1 and the rear edge 4-1-2 remains constant, which has been described in the previous embodiments.

The first transition surface 4-1 in the lateral transition surface 4 of type (b) shown in the Figure is a twisted surface, the lateral projection of the front edge 4-1-1 of which inclines forward from top to bottom, and the lateral projection of the rear edge 4-1-2 inclines backward from top to bottom. Viewed from the side, the width between the front edge 4-1-1 and the rear edge 4-1-2 gradually increases from top to bottom.

The first transition surface 4-1 in the lateral transition surface 4 of type (c) shown in the Figure is a twisted surface, the lateral projection of the front edge 4-1-1 of which inclines forward from top to bottom, and the lateral projection of the rear edge 4-1-2 remains vertical. Viewed from the side, the width between the front edge 4-1-1 and the rear edge 4-1-2 gradually increases from top to bottom.

The first transition surface 4-1 in the lateral transition surface 4 of type (d) shown in the Figure is a twisted surface, the lateral projection of the front edge 4-1-1 of which remains vertical, and the lateral projection of the rear edge 4-1-2 inclines backward from top to bottom. Viewed from the side, the width between the front edge 4-1-1 and the rear edge 4-1-2 gradually increases from top to bottom.

The first transition surface 4-1 in the lateral transition surface 4 of type (e) shown in the Figure is a twisted surface, the lateral projection of the front edge 4-1-1 of which inclines backward from top to bottom, and the lateral projection of the rear edge 4-1-2 inclines forward from top to bottom. Viewed from the side, the width between the front edge 4-1-1 and the rear edge 4-1-2 gradually decreases from top to bottom.

The first transition surface 4-1 in the lateral transition surface 4 of type (f) shown in the Figure is a twisted surface, the lateral projection of the front edge 4-1-1 of which remains vertical, and the lateral projection of the rear edge 4-1-2 inclines forward from top to bottom. Viewed from the side, the width between the front edge 4-1-1 and the rear edge 4-1-2 gradually decreases from top to bottom.

The first transition surface 4-1 in the lateral transition surface 4 of type (g) shown in the Figure is a twisted surface, the lateral projection of the front edge 4-1-1 of which inclines backward from top to bottom, and the lateral projection of the rear edge 4-1-2 remains vertical. Viewed from the side, the width between the front edge 4-1-1 and the rear edge 4-1-2 gradually decreases from top to bottom.

The intersection line between the first transition surface 4-1 of the types (a) to (g) described above and the horizontal plane is a straight line.

Figure 32:
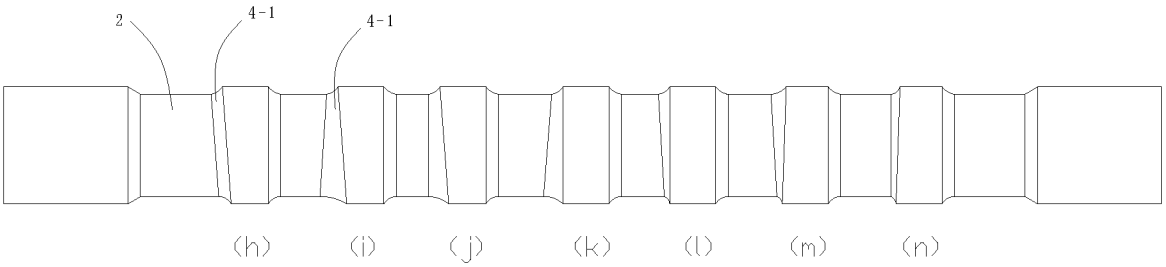
FIG. 32 is a schematic view of concentrated display of type (h)~(n) lateral transition surfaces formed on the pile body.

Referring to FIG. 32, FIG. 32 is a schematic view of concentrated display of type (h)~(n) lateral transition surfaces formed on the pile body.

As shown in the Figure, in other embodiments, the lateral transition surface 4 of the small-section segment 2 may have various forms.

The first transition surface 4-1 in the lateral transition surface 4 of type (h) shown in the Figure is a concave surface, which can be a cylindrical surface or an elliptical cylindrical surface. The front edge 4-1-1 and the rear edge 4-1-2 of the first transition surface are parallel. Viewed from the side, the width between the front edge 4-1-1 and the rear edge 4-1-2 remains constant from top to bottom.

The first transition surface 4-1 in the lateral transition surface 4 of type (i) shown in the Figure is a tapered or twisted surface, the lateral projection of the front edge 4-1-1 of which inclines forward from top to bottom, and the lateral projection of the rear edge 4-1-2 inclines backward from top to bottom. Viewed from the side, the width between the front edge 4-1-1 and the rear edge 4-1-2 gradually increases from top to bottom.

The first transition surface 4-1 in the lateral transition surface 4 of type (j) shown in the Figure is a tapered or twisted surface, the lateral projection of the front edge 4-1-1 of which inclines forward from top to bottom, and the lateral projection of the rear edge 4-1-2 remains vertical. Viewed from the side, the width between the front edge 4-1-1 and the rear edge 4-1-2 gradually increases from top to bottom.

The first transition surface 4-1 in the lateral transition surface 4 of type (k) shown in the Figure is a tapered or twisted surface, the lateral projection of the front edge 4-1-1 of which remains vertical, and the lateral projection of the rear edge 4-1-2 inclines backward from top to bottom. Viewed from the side, the width between the front edge 4-1-1 and the rear edge 4-1-2 gradually increases from top to bottom.

The first transition surface 4-1 in the lateral transition surface 4 of type (l) shown in the Figure is a tapered or twisted surface, the lateral projection of the front edge 4-1-1 of which remains vertical, and the lateral projection of the rear edge 4-1-2 inclines forward from top to bottom. Viewed from the side, the width between the front edge 4-1-1 and the rear edge 4-1-2 gradually decreases from top to bottom.

The first transition surface 4-1 in the lateral transition surface 4 of type (m) shown in the Figure is a tapered or twisted surface, the lateral projection of the front edge 4-1-1 of which inclines backward from top to bottom, and the lateral projection of the rear edge 4-1-2 inclines forward from top to bottom. Viewed from the side, the width between the front edge 4-1-1 and the rear edge 4-1-2 gradually decreases from top to bottom.

The first transition surface 4-1 in the lateral transition surface 4 of type (n) shown in the Figure is a tapered or twisted surface, the lateral projection of the front edge 4-1-1 of which inclines backward from top to bottom, and the lateral projection of the rear edge 4-1-2 remains vertical. Viewed from the side, the width between the front edge 4-1-1 and the rear edge 4-1-2 gradually decreases from top to bottom.

The intersection line between the first transition surface 4-1 of the types (h) to (n) described above and the horizontal plane is an inwardly concave arc.

Figure 33:
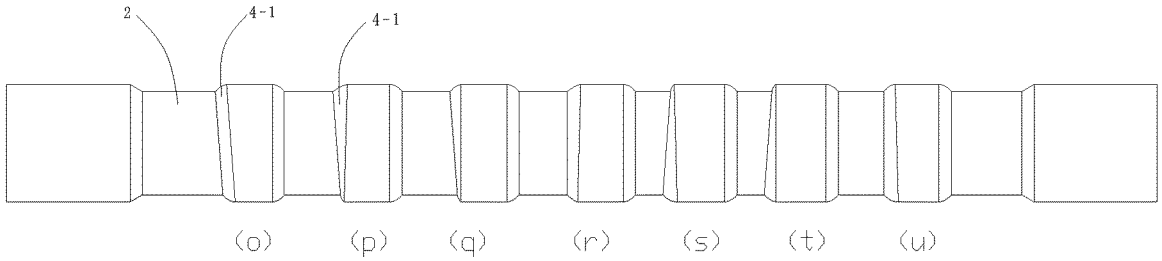
FIG. 33 is a schematic view of concentrated display of type (o)~(u) lateral transition surfaces formed on the pile body.

Referring to FIG. 33, FIG. 33 is a schematic view of concentrated display of type (o)~(u) lateral transition surfaces formed on the pile body.

As shown in the Figure, in other embodiments, the lateral transition surface 4 of the small-section segment 2 may have various forms.

The first transition surface 4-1 in the lateral transition surface 4 of type (o) shown in the Figure is a convex surface, which can be a cylindrical surface or an elliptical cylindrical surface. The front edge 4-1-1 and the rear edge 4-1-2 of the first transition surface are parallel. Viewed from the side, the width between the front edge 4-1-1 and the rear edge 4-1-2 remains constant from top to bottom.

The first transition surface 4-1 in the lateral transition surface 4 of type (p) shown in the Figure is a tapered or twisted surface, the lateral projection of the front edge 4-1-1 of which inclines backward from top to bottom, and the lateral projection of the rear edge 4-1-2 inclines forward from top to bottom. Viewed from the side, the width between the front edge 4-1-1 and the rear edge 4-1-2 gradually decreases from top to bottom.

The first transition surface 4-1 in the lateral transition surface 4 of type (q) shown in the Figure is a tapered or twisted surface, the lateral projection of the front edge 4-1-1 of which remains vertical, and the lateral projection of the rear edge 4-1-2 inclines forward from top to bottom. Viewed from the side, the width between the front edge 4-1-1 and the rear edge 4-1-2 gradually decreases from top to bottom.

The first transition surface 4-1 in the lateral transition surface 4 of type (r) shown in the Figure is a tapered or twisted surface, the lateral projection of the front edge 4-1-1 of which inclines backward from top to bottom, and the lateral projection of the rear edge 4-1-2 remains vertical. Viewed from the side, the width between the front edge 4-1-1 and the rear edge 4-1-2 gradually decreases from top to bottom.

The first transition surface 4-1 in the lateral transition surface 4 of type (s) shown in the Figure is a tapered or twisted surface, the lateral projection of the front edge 4-1-1 of which inclines forward from top to bottom, and the lateral projection of the rear edge 4-1-2 inclines backward from top to bottom. Viewed from the side, the width between the front edge 4-1-1 and the rear edge 4-1-2 gradually increases from top to bottom.

The first transition surface 4-1 in the lateral transition surface 4 of type (t) shown in the Figure is a tapered or twisted surface, the lateral projection of the front edge 4-1-1 of which remains vertical, and the lateral projection of the rear edge 4-1-2 inclines backward from top to bottom. Viewed from the side, the width between the front edge 4-1-1 and the rear edge 4-1-2 gradually increases from top to bottom.

The first transition surface 4-1 in the lateral transition surface 4 of type (u) shown in the Figure is a tapered or twisted surface, the lateral projection of the front edge 4-1-1 of which inclines forward from top to bottom, and the lateral projection of the rear edge 4-1-2 remains vertical. Viewed from the side, the width between the front edge 4-1-1 and the rear edge 4-1-2 gradually increases from top to bottom.

The intersection line between the first transition surface 4-1 of the types (o) to (u) described above and the horizontal plane is an outwardly convex arc.

Figure 34:
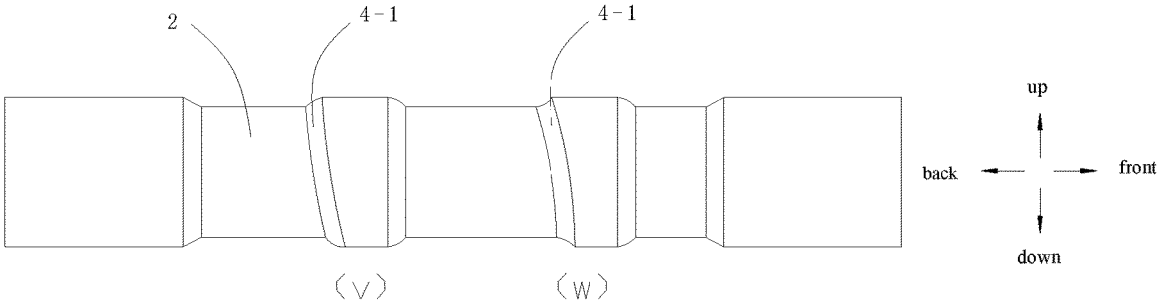
FIG. 34 is a schematic view of concentrated display of type (v)~(w) lateral transition surfaces formed on the pile body.

Referring to FIG. 34, FIG. 34 is a schematic view of concentrated display of type (v)~(w) lateral transition surfaces formed on the pile body.

As shown in the Figure, in other embodiments, the lateral transition surface 4 of the small-section segment 2 may have various forms.

The first transition surface 4-1 in the lateral transition surface 4 of type (v) shown in the Figure is a convex surface, the front edge 4-1-1 and rear edge 4-1-2 of which are in shape of paralleled arcs, and bend forward from top to bottom. Viewed from the side, the width between the front edge 4-1-1 and the rear edge 4-1-2 remains constant.

The first transition surface 4-1 in the lateral transition surface 4 of type (w) shown in the Figure is a concave surface, the front edge 4-1-1 and rear edge 4-1-2 of which are in shape of parallel arcs, and bend forward from top to bottom. Viewed from the side, the width between the front edge 4-1-1 and the rear edge 4-1-2 remains constant.

Figure 35:
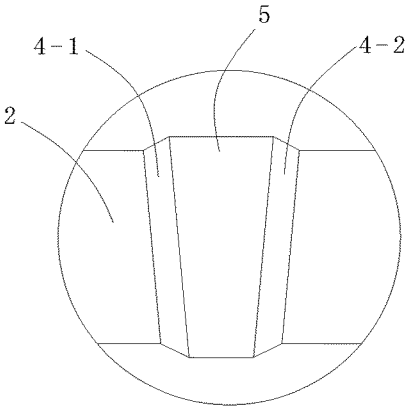
FIG. 35 is a schematic partial structural schematic view of the same large-section segment with the front lateral transition surface and the rear lateral transition surface being symmetrical.

Although the large-section segment 3 in the middle shown in FIG. 31 to FIG. 34 is formed with an improved first transition surface 4-1 only on one side, it can be understood that, for each large-section segment 3 located in the middle, the lateral transition surfaces 4 on both sides thereof can be configured as the symmetrical structure as shown in FIG. 35. In addition, the lateral transition surfaces 4 located on both sides of the large-section segment 3 in the middle may also be any two different types of lateral transition surfaces above.

The prefabricated variable cross-section square piles are prefabricated by reinforced concrete in the workshop. After the prefabricated piles are connected, gaps easily appear at the joint of piles, so it is easy for the underground acid and alkali corrosive substances to enter from the gaps into the piles to corrode the metal connection pieces. To solve this technical problem, the solutions in the following embodiments can be adopted.

In these embodiments, the end structure and internal reinforcement structure of prefabricated square piles with variable cross-section are mainly introduced. For the sake of simplicity, the variable cross-section prefabricated square pile shown in the Figure adopts a simplified drawing method, and the large-section segment, small-section segment and lateral transition surface are not shown. Such omission may not affect the understanding and reproduction to the technical solutions of the present disclosure by those skilled in the art.

Figure 36:
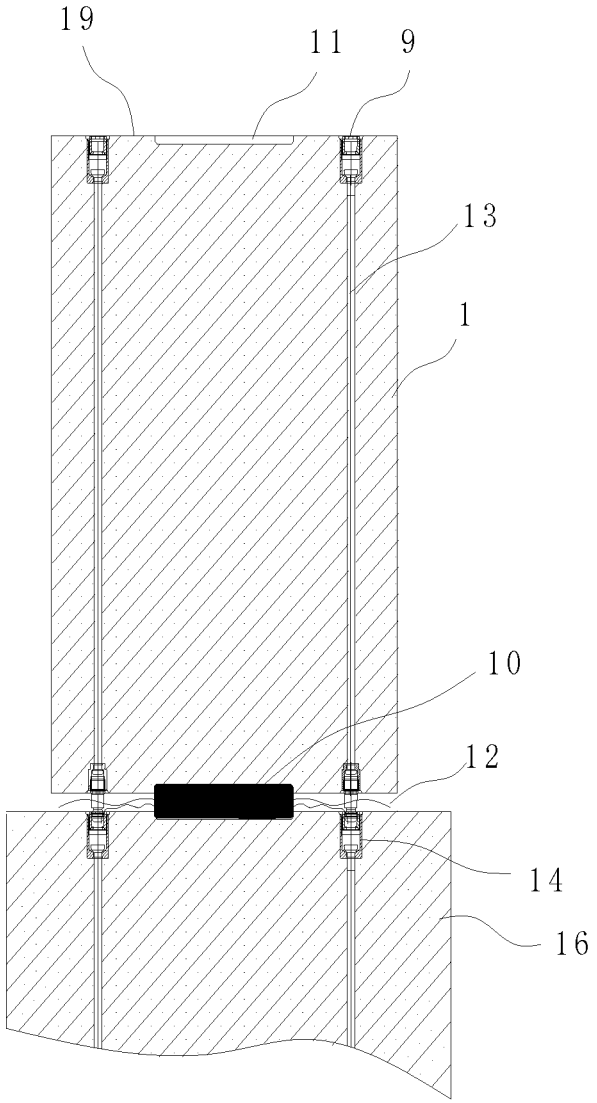
FIG. 36 is a schematic view of the installation structure of the variable cross-section prefabricated square pile disclosed in the twelfth embodiment of the present disclosure.

Referring to FIG. 36, FIG. 36 is a schematic view of the installation structure of the variable cross-section prefabricated square pile disclosed in the twelfth embodiment of the present disclosure.

As shown in the Figure, a variable cross-section prefabricated square pile is provided according to this embodiment. The variable cross-section prefabricated square pile is a concrete member prefabricated in a factory, and there is usually a skeleton composed of several steel bars inside, and multiple connecting holes 9, which are spaced apart, are provided on the pile end surface 19 corresponding to the steel bars. A mechanical connection piece 14 is installed in the connecting hole 9 for connecting with other external objects, so as to realize continuous stress transmission and improve the connection strength and reliability between the prefabricated concrete components.

In this embodiment, the external object is a concrete member, such as a bearing platform, a foundation, etc., where the mechanical connection piece 14 is a mechanical connection piece commonly used in the field (e.g., the connection pieces disclosed in patent documents CN201510649253.6, CN201510314380.0, etc.).

Specifically, at least one pile end surface 19 of the prefabricated pile has a groove 11, which is configured to at least partially accommodate a storage block 10 in which the viscous substance 12 is stored. In a case that the pile end surface 19 abuts the external object, the storage block 10 is pressed so as to release the viscous substance 12. The viscous substance 12 overflows the groove 11 to separate the connecting hole 9 and the edge of the pile end surface 19 closest to the connecting hole in order to protect the mechanical connection piece 14 and prevent dust, sediment, water, etc. from entering the mechanical connection piece 14 through the gaps between the pile end surface 19 and external objects and thus corroding the mechanical connection piece 14.

Figure 37:
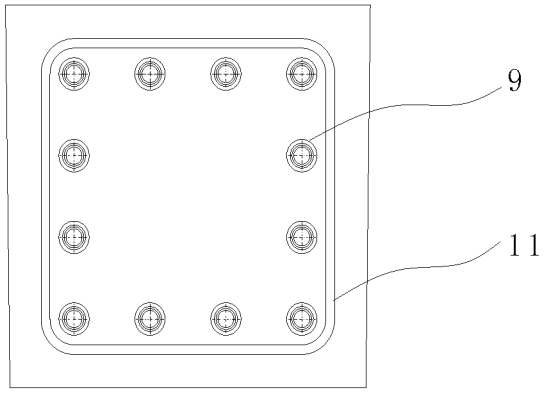
FIG. 37 is a schematic view of the position and shape of the grooves on the end face of the prefabricated pile in FIG. 36.
Figure 38:
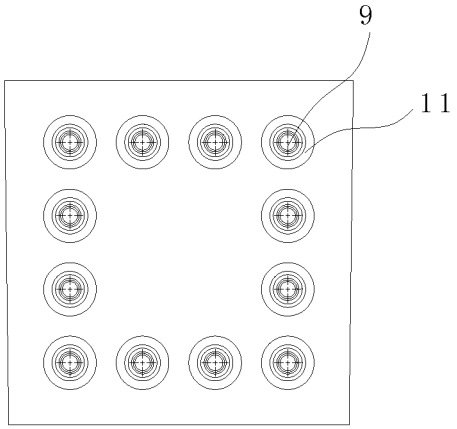
FIG. 38 is another schematic view of the position and shape of the grooves on the end face of the prefabricated pile in FIG. 36.
Figure 39:
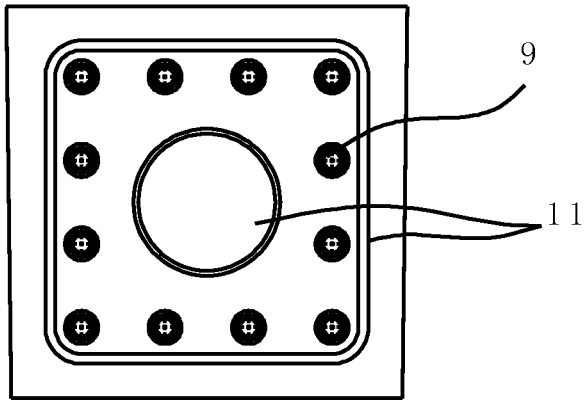
FIG. 39 is another schematic view of the position and shape of the grooves on the end face of the prefabricated pile in FIG. 36.
Figure 40:
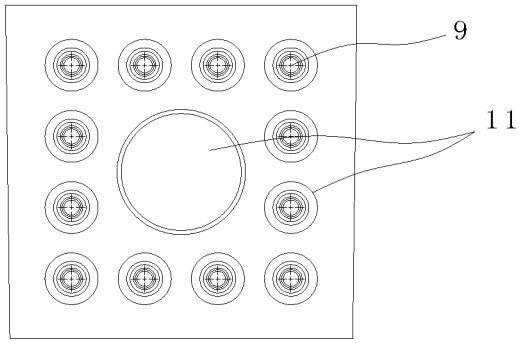
FIG. 40 is another schematic view of the position and shape of the grooves on the end face of the prefabricated pile in FIG. 36.

In this embodiment, the upper and lower end surfaces of the prefabricated piles are provided with grooves 11, respectively, as shown in FIG. 36. In order to make the viscous substance 12 evenly protect all mechanical connection pieces 14 in the connecting holes 9, the groove 11 is placed at the center of the pile end surface 19 of the prefabricated pile, and the shape of the groove 11 can be set according to the shape of the pile end surface 19 of the prefabricated pile, which can be circle, ring, rectangle or regular polygon, etc. The groove 11 can also be annular, surrounding all the connecting holes 9. Or, each connecting hole 9 is surrounded by one groove 11 to separate the connecting hole 9 from the edge of the pile end surface 19, as shown in FIG. 37 to FIG. 38. Since the viscous substance 12 has fluidity, it can flow along the pile end surface 19 after being squeezed out of the groove 11. The annular groove 11 may also only surround some connecting holes 9, or only some connecting holes 9 are surrounded one an annular groove 11, respectively. In a case that the pile end surface 19 is provided with multiple grooves 11, combination of which can be made according to the shapes and positions thereof, as shown in FIG. 39 to FIG. 40. Of course, the groove 11 may also have other shapes, other positions and combinations, which are not limited to the situation shown in this embodiment.

As a preferred technical means, in order to ensure that the storage block 10 can be stably placed in the groove 11 and compressed, and a sufficient amount of the viscous substance 12 can be stored in the groove 11 after overflowing out the groove 11, the depth of the groove 11 is set to be greater than 0.5% of the diameter of the prefabricated pile and less than the height of the storage block 10. With this structure, when the pile end surface 19 of prefabricated pile is inclined due to production error, a sufficient blocking surface can be provided by the groove 11 to the storage block 10 placed in the groove so as to prevent the storage block 10 from toppling over.

Figure 41:
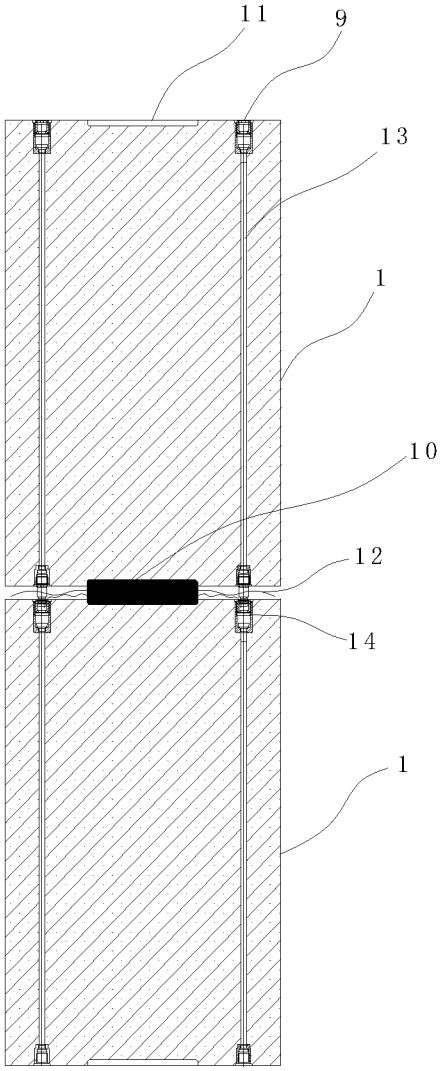
FIG. 41 is a schematic view of a pile connection process of the variable cross-section prefabricated square pile disclosed in the thirteenth embodiment of the present disclosure.
Figure 42:
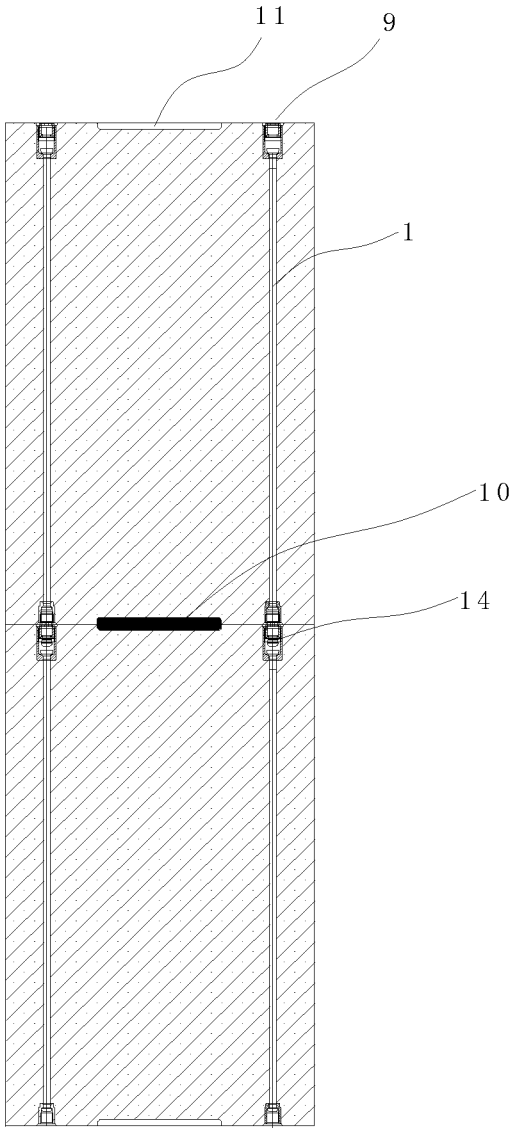
FIG. 42 is a schematic view of the completion state of the pile connection process of the variable cross-section prefabricated square pile in FIG. 41.

Referring to FIG. 41 and FIG. 42, FIG. 41 is a schematic view of the pile connection process of the variable cross-section prefabricated square pile disclosed in the thirteenth embodiment of the present disclosure; and FIG. 42 is a schematic view of the completion state of pile connection process of the variable cross-section prefabricated square pile in FIG. 41.

In this embodiment, the same reference numerals represent the same parts with those in the twelfth embodiment, and the same descriptions to which are omitted.

A pile connecting structure is provided according to this embodiment, which includes a viscous substance 12, at least two prefabricated piles which are vertically butted in sequence, and at least one storage block 10 which is located between two adjacent prefabricated piles and stores the viscous substance. At least one of the two adjacent prefabricated piles is the prefabricated pile provided in the first embodiment, and the two adjacent prefabricated piles that are vertically butted in sequence are the prefabricated piles in the upper section and the prefabricated piles in the lower section, respectively. Compressing the storage block 10 can release the viscous substance 12 to eliminate and/or fill the gap between the pile connecting end surfaces of two adjacent prefabricated piles.

The grooves 11 are provided in the lower end surface of the prefabricated pile of the upper section and the upper end surface of the prefabricated pile of the lower section, respectively, and the positions of the grooves 11 on the two prefabricated piles correspond to each other and the shapes of the grooves 11 are matched. The shapes of the grooves 11 on the two prefabricated piles can also be incompatible, and the space where the grooves 11 on the two prefabricated piles overlap in the axial direction can accommodate the storage block 10. In order to facilitate the storage block 10 of being completely placed in the groove 11 after the pile connection, the minimum thickness that the storage block 10 can reach after being compressed is less than or equal to the sum of the depths of the corresponding two grooves 11. Of course, the shapes of the corresponding grooves 11 may also be incompatible or not corresponding. In order to ensure the storage block 10 to be completely placed in the groove 11 after the pile connection, the minimum thickness that the storage block 10 can reach after being compressed is less than or equal to the depth of the groove 11 where it is located. As another preferred solution, a groove 11 is provided only on any one pile end surfaces 19 among the lower end surface of the prefabricated pile of the upper section and the upper end surface of the prefabricated pile of the lower section. In order to facilitate the storage block 10 of being completely placed in the groove 11 after the pile connection, the minimum thickness that the storage block 10 can reach after being compressed is less than or equal to the depth of the groove 11. Of course, whether the grooves 11 are provided on the end surfaces of the two prefabricated piles as well as the positions of the grooves 11 can be set according to the real situation, and other positions and combinations are also possible, which is not limited to the situation shown in this embodiment. The storage block 10 is an elastic water-absorbing material, such as a sponge, etc., which has good elasticity and water absorption, and can absorb and store a large amount of viscous substances 12. The viscous substance 12 is generally a flowable and curable material such as epoxy resin or modified epoxy resin. When the end surfaces for pile connection of the upper prefabricated pile and the lower prefabricated pile are close to each other until abutting, the storage block 10 is compressed by the pressing force of the upper prefabricated pile and the lower prefabricated pile, as shown in FIG. 41. The viscous substance 12 is squeezed from the storage block 10 and overflows the groove 11 to cover the pile end surface 19, thereby isolating the pile end surface 19, preventing it from contacting with the outside air, water or sand, etc., and sealing and corrosion protecting the end surface of the prefabricated pile; the storage block 10 may also be a capsule made of flexible material, filled with a certain amount of viscous substance 12 inside. When being pressed by the pile end surface 19, the storage block 10 is cracked, and the viscous substance 12 flows out from the above broken gap. Alternatively, the storage block 10 is porous, the pores are expanded as being compressed, and the viscous substance 12 is squeezed from the small pores.

With the above structure, the process of manually applying the viscous substance 12 is omitted. As shown in FIG. 41, after the upper prefabricated pile is lifted and aligned with the lower prefabricated pile, the mechanical connection piece is filled with viscous substance 12, and the storage block 10 dipped with viscous substance 12 or prepared in advance with viscous substance 12 inside is put into the groove 11. When the viscous substance 12 stored in the storage block 10 reaches a certain amount, the step of injecting the viscous substance 12 into the mechanical connection piece 14 can be further omitted. The viscous substance 12 in the storage block 10 flows into and fills the mechanical connection piece 14 through the pile end surface 19, which is convenient and quick, and improves the working efficiency. Meanwhile, since the volume of the storage block 10 is a reserved value, that is, the viscous substance 12 stored in the storage block 10 is also a reserved value, the quantitative use of the viscous substance 12 is realized, which avoid the waste of the viscous substance 12 caused by improper operation, and the cost is saved. The prefabricated pile in the upper section is pressed down, and thus the viscous substance 12 in the storage block 10 is squeezed out and flows along the pile end surface 19; and the pressing-down is continued until the pile end surfaces are fitted together, and the storage block 10 is completely compressed in the groove 11, as shown in FIG. 42, at this time, the pile connection is completed. Due to the elastic effect of the storage block 10, it is tightly attached to the inner wall of the groove 11 after being compressed, and the storage block 10 still has a certain amount of viscous substance 12. After the viscous substance 12 is solidified, the upper prefabricated pile and the lower prefabricated pile are connected into one piece, which ensures the pass rate for small strain detection and improves the pile connection performance of the prefabricated pile.

Figure 43:
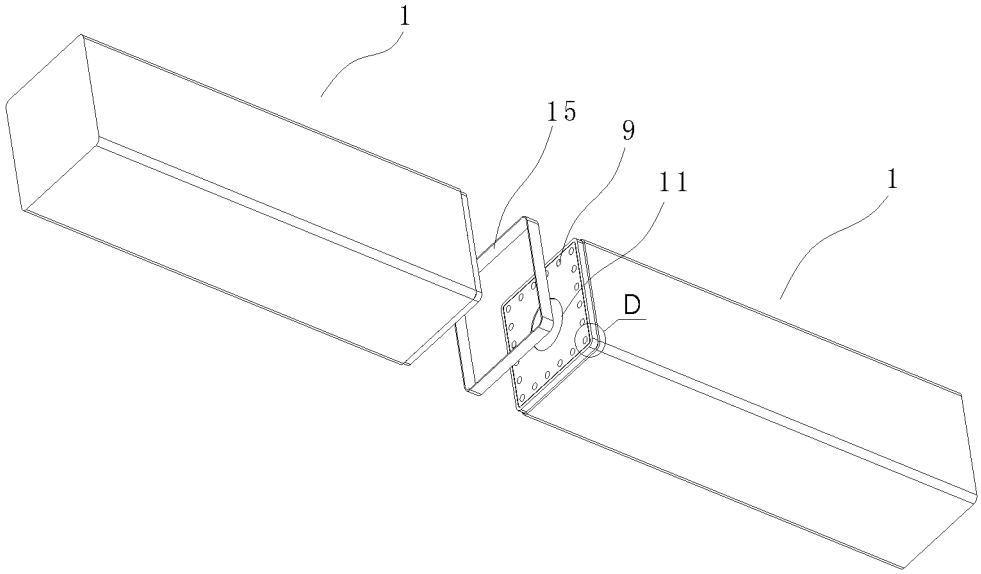
FIG. 43 is a schematic view of the connecting structure of the variable cross-section prefabricated square pile disclosed in the fourteenth embodiment of the present disclosure.
Figure 44:
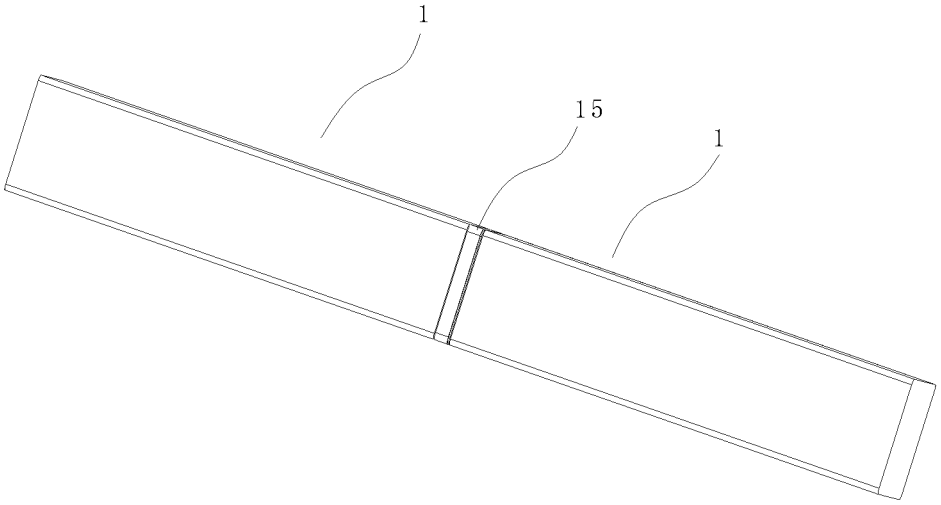
FIG. 44 is a schematic view of the completed state of the pile connection process of the variable cross-section prefabricated square pile in FIG. 43.
Figure 45:
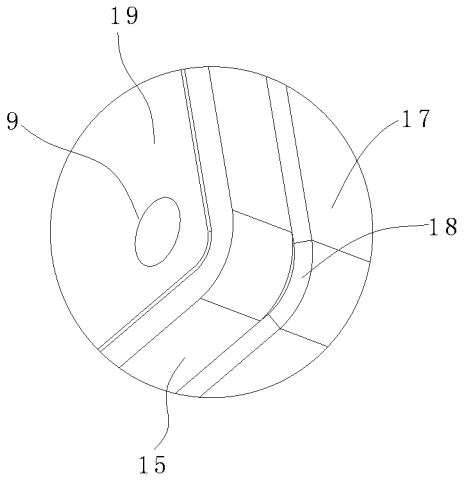
FIG. 45 is an enlarged view of the structure at D in FIG. 43.

Referring to FIG. 43, FIG. 44 and FIG. 45, FIG. 43 is a schematic view of the connecting structure of the variable cross-section prefabricated square pile disclosed in the fourteenth embodiment of the present disclosure; FIG. 44 is a schematic view of the completion state of the pile connection of the variable cross-section prefabricated square pile in FIG. 43; and FIG. 45 is an enlarged view of the structure at D in FIG. 43.

In this embodiment, the same reference numerals represent the same parts with those in the thirteenth embodiment, and the same descriptions to which are omitted.

Compared with the thirteenth embodiment, the pile connecting structure of the embodiment further includes a corrosion-resistant sealing ring 15, and the sealing ring 15 is sleeved at the joint of two adjacent vertically butted prefabricated piles. The sealing ring 15 is sleeved on the pile body close to the pile end surface 19 before performing the pile connection, and then the abutment for two prefabricated piles is carried out. After the pile connection is completed, the sealing ring 15 is dragged to move to the joint of the end surfaces of the two prefabricated piles and wrap it. Since the sealing ring 15 has certain elasticity, after the completion of sleeve connection, the sealing ring 15 is pressed against the prefabricated pile to seal the joint of the pile end surface 19, which prevents the viscous substance 12 from flowing out without solidification and reduces the loss of the viscous substance 12.

Further, the diameter of the pile end of the prefabricated pile is less than the diameter of the pile body, and the thickness of the sealing ring 15 is less than or equal to ½ of the difference between the diameter of the pile body and the diameter of the pile end. The width of the sealing ring 15 is less than or equal to twice the length of the pile end, so as to ensure that the sealing ring 15 does not protrude from the pile body, and the soil will not push the sealing ring 15 away from the original position when piling. Preferably, in order to facilitate the installation of the sealing ring 15, a smooth transition portion 18 is provided between the pile end and the pile body.

Figure 46:
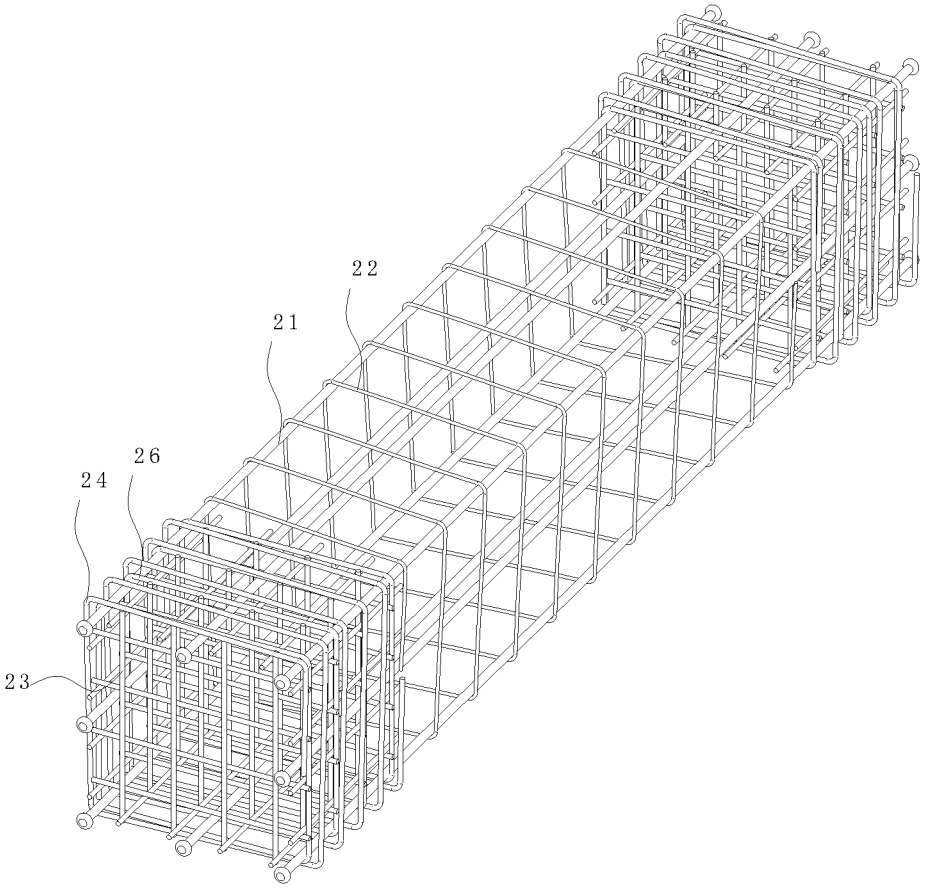
FIG. 46 is a schematic structural view of the rigid skeleton of the variable cross-section prefabricated square pile disclosed in the fifteenth embodiment of the present disclosure.
Figure 47:
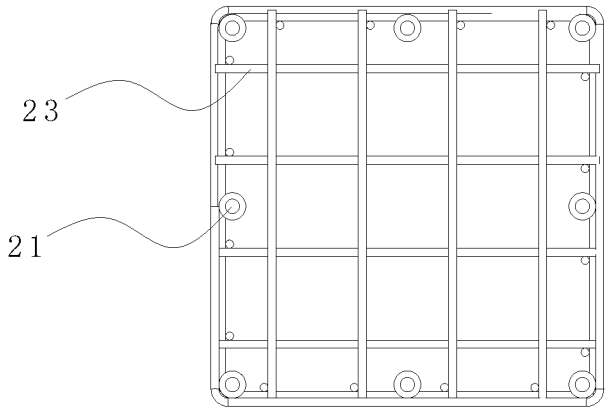
FIG. 47 is an end view of the rigid skeleton shown in FIG. 46.
Figure 55:
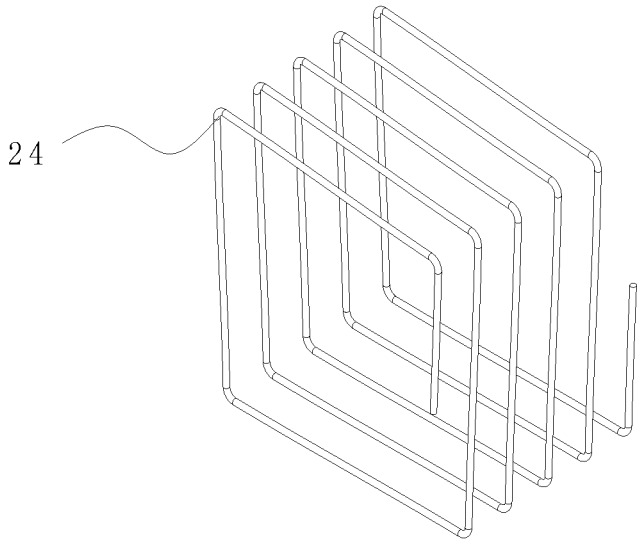
FIG. 55 is a schematic structural view of an auxiliary stirrup.
Figure 56:
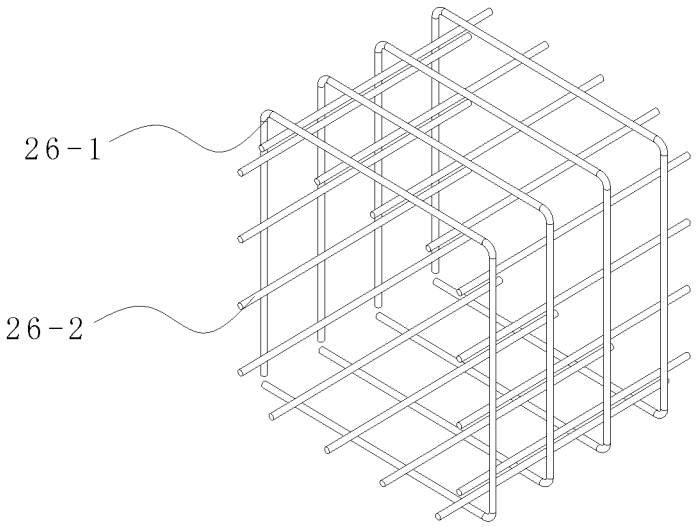
FIG. 56 is a schematic structural view of a rigid mesh enclosure.

Referring to FIG. 46, FIG. 47, FIG. 55, FIG. 56, FIG. 46 is a schematic structural view of the rigid skeleton of the variable cross-section prefabricated square pile disclosed in the fifteenth embodiment of the present disclosure; FIG. 47 is an end view of the rigid skeleton shown in FIG. 46; FIG. 55 is a schematic structural view of an auxiliary stirrup; and FIG. 56 is a schematic structural view of a rigid mesh enclosure;

As shown in the Figure, the rigid skeleton for the pile of the variable cross-section prefabricated square pile in this embodiment includes: a rigid skeleton for prefabricated piles which is formed multiple main reinforcements 21 being spaced apart and wound to form a reserved cavity, and a skeleton stirrup 22 for fastening and fixing the main reinforcement skeleton. The ends of the main reinforcement skeletons are bound with rigid mesh enclosures 26 and/or rigid meshes 23 to enhance the structural strength of the prefabricated piles. The ends of the main reinforcement skeleton are fastened and fixed by auxiliary stirrups 24, and an interval between the auxiliary stirrups 24 is less than or equal to an interval of the skeleton stirrups.

Specifically, a rigid mesh enclosure 26 is provided at the end of the main reinforcement skeleton, and auxiliary stirrups 24 are wound around the end of the main reinforcement skeleton. The rigid mesh enclosure 26 and the main reinforcement 21 are tightened, which can prevent the main reinforcement 21 at the end of the main reinforcement skeleton from being blasted by pumping concrete when making concrete prefabricated piles, and protect the end structure of the main reinforcement skeleton. It may also prevent the main reinforcement 21 from being blasted by the impact during piling, and enhance the structural strength of the end of the concrete prefabricated pile. If the interval between the auxiliary stirrups and the main reinforcement 21 is relative great, it cannot prevent the main reinforcement skeleton from being blasted, so the auxiliary stirrups 24 need to be close to the main reinforcement 21. Also, the structural strength of the main reinforcement skeleton can be better enhanced by limiting the interval between the auxiliary stirrups 24. Preferably, the rigid skeleton for the prefabricated pile is a steel cage, the frame stirrups and the auxiliary stirrups are spiral stirrups, and the rigid mesh enclosure 26 is a rebar mesh enclosure.

Preferably, the auxiliary stirrups 24 and the rigid mesh enclosure 26 are fixedly connected, where the auxiliary stirrups 24 are located outside the rigid mesh enclosure 26. After the rigid mesh enclosures 26 are bound at the end of the main reinforcement skeleton, the auxiliary stirrups 24 are ferruled around the rigid mesh enclosure 26, so that the main reinforcement skeleton can bear greater peening force and the auxiliary stirrups 24 can be prevented from loosening.

Figure 54:
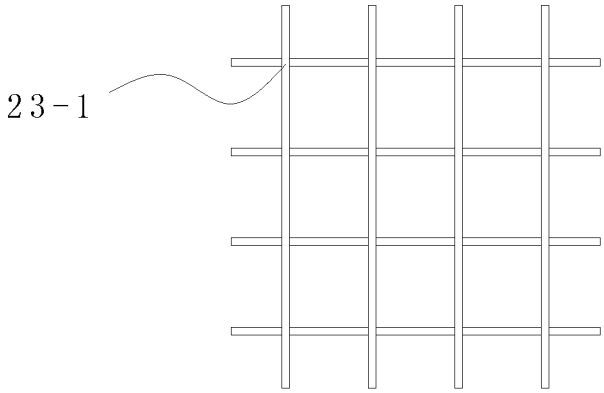
FIG. 54 is a schematic structural view of a rigid mesh.

As shown in FIG. 46 and FIG. 54, the rigid mesh enclosure 26 includes multiple annular reinforcements 26-1 arranged in sequence along the length of the main reinforcement skeleton and multiple axial reinforcements 26-2 for connecting and fixing the annular reinforcements 26-1, and the axial reinforcements 26-2 are parallel to main reinforcement 21. Preferably, the axial reinforcements 26-2 are fixedly connected along the inner circumferential direction of the annular reinforcement 26-1, which may ensure that the rigid mesh enclosures 26 are evenly subjected to the force.

A rigid mesh enclosure 26 is bound at the end of the main reinforcement skeleton, which can ferrule the end of the main reinforcement skeleton together with the auxiliary stirrup 24, so that the main reinforcement 21 of the main reinforcement skeleton is less likely to be disassembled. Preferably, the rigid mesh enclosure 26 may be a rebar mesh enclosure.

The rigid meshes 23 are arranged at the ends of the main reinforcement skeleton and arranged at intervals along the length direction of the reserved cavity. The structural strength and peening resistance of the end of the concrete prefabricated pile can be strengthened, and the end of the concrete prefabricated pile can be prevented from being blasted during pile driving. In this embodiment, the rigid mesh 23 may be provided separately, or the rigid mesh enclosure 26 may also be provided separately, or the rigid mesh 23 and the rigid mesh enclosure 26 may be provided together.

The rigid mesh 23 includes several cross-connected and fixed reinforcing stiffeners 23-1, and the ends of the rigid mesh 23 are fixedly connected with the auxiliary stirrups 24 and/or with the main reinforcement skeleton. The rigid mesh 23 is grid-shaped, which can not only enhance the strength of the end of the prefabricated concrete pile, but also ensure that the concrete can fully wrap the reinforcing stiffeners 23-1 when manufacturing the prefabricated concrete pile, thus ensure of being evenly subjected to the force. In addition, the end of the rigid mesh 23 can be connected to the auxiliary stirrups 24, the main reinforcement 21, or both the auxiliary stirrups 24 and the main reinforcement 21 so as to ensure the stable connection of the rigid mesh 23.

Specifically, the plane where the rigid mesh 23 is located is perpendicular to the central axis of the axial reinforcement 26-2. The rigid meshes 23 are arranged on the rigid mesh enclosure 26 in sequence perpendicular to the axial reinforcement 26-2, and the reserved cavity is divided into several small spaces along the length direction, so that the concrete at the end of the concrete prefabricated pile can be more compact.

Preferably, the rigid mesh 23 is connected to the rigid mesh enclosure 26 and then is bound on the end of the main reinforcement skeleton. The rigid mesh 23 can be connected to the rigid mesh enclosure 26 in advance to form an integrated structure, which facilitates the placement of the rigid mesh 23. At least one rigid mesh 23 is connected to the end of the rigid mesh enclosure 26, so that the rigid mesh enclosure 26 has a blocking surface and enhances the structural strength of the end of the rigid mesh enclosure 26. The connection form of the rigid mesh 23 on the rigid mesh enclosure 26 can be such that the rigid meshes 23 are all connected with the annular reinforcements 26-1, or the rigid meshes 23 are all connected with the axial reinforcements 26-2, or part of the rigid meshes 23 are connected with the annular reinforcements 26-1 and part of the rigid meshes 23 are connected with the axial reinforcements 26-2.

The working principle of this embodiment: during prefabrication, the main reinforcement 21 is ferruled with the skeleton stirrups 22 to form the main reinforcement skeleton, and the rigid mesh 23 is connected to the rigid mesh enclosure 26 at the same time. Then the rigid mesh enclosures 26 are bound on the end of the main reinforcement skeleton, and finally the rigid mesh enclosure 26 and the main reinforcement 21 are ferruled by the auxiliary stirrups 24. It may prevent the main reinforcement 21 at the end of the main reinforcement skeleton from being blasted by pumping concrete when making concrete prefabricated piles, and protect the end structure of the main reinforcement skeleton. At the same time, the structural strength and peening resistance of the end of the prefabricated concrete pile are enhanced, which can prevent the end of the prefabricated concrete pile from bursting during pile driving.

Figure 48:
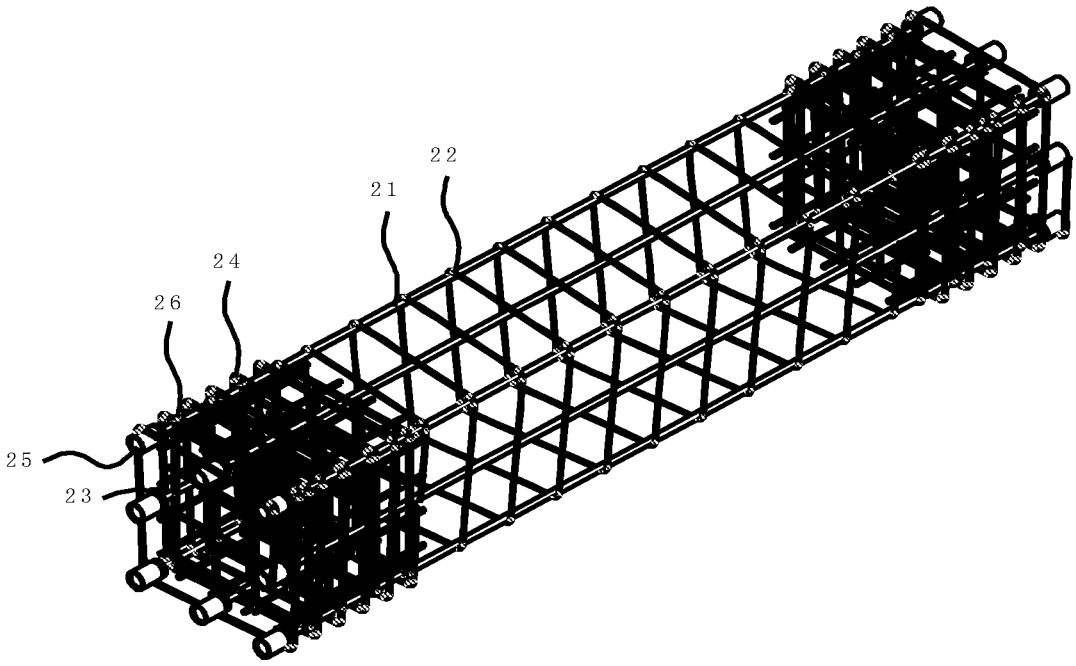
FIG. 48 is a schematic structural view of the rigid skeleton of the variable cross-section prefabricated square pile disclosed in the sixteenth embodiment of the present disclosure.
Figure 49:
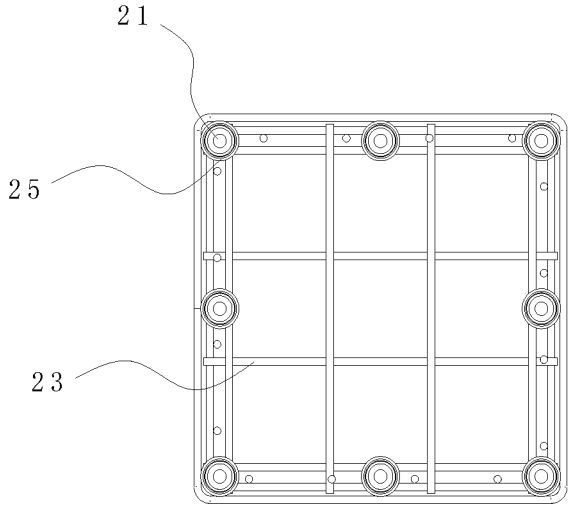
FIG. 49 is an end view of the rigid skeleton shown in FIG. 48.

Referring to FIG. 48, FIG. 49, FIG. 48 is a schematic structural view of the rigid skeleton of the variable cross-section prefabricated square pile disclosed in the sixteenth embodiment of the present disclosure; and FIG. 49 is an end view of the rigid skeleton shown in FIG. 48.

In this embodiment, the same reference numerals represent the same parts with those in the fifteenth embodiment, and the same descriptions to which are omitted.

Compared with the fifteenth embodiment, the difference of this embodiment is in that: connecting nuts 25 are provided at the end of the main reinforcement, and the auxiliary stirrup 24 is connected and fixed with at least one of the connecting nuts 25. The prefabricated piles are connected by the connecting nuts 25 and insert rods, and thus connecting nuts 25 are provided at the top of the main reinforcement 21, if the interval between the auxiliary stirrup 24 and the connecting nut 25 is relative great, it cannot prevent the main reinforcement skeleton from being blasted. Therefore, the auxiliary stirrups 24 need to be connected and fixed at least one connecting nut 25, so as to prevent the connecting nut 25 from being disassembled by peening, resulting in the displacement of the connection between the prefabricated piles.

Figure 50:
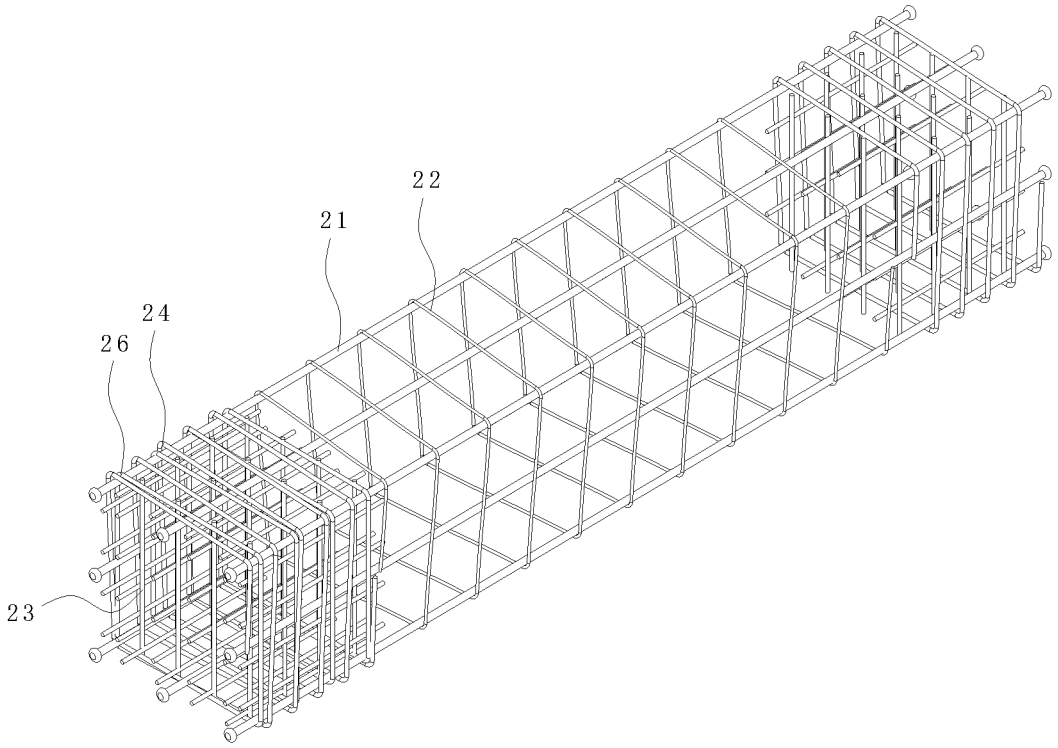
FIG. 50 is a schematic structural view of the rigid skeleton of the variable cross-section prefabricated square pile disclosed in the seventeenth embodiment of the present disclosure.
Figure 51:
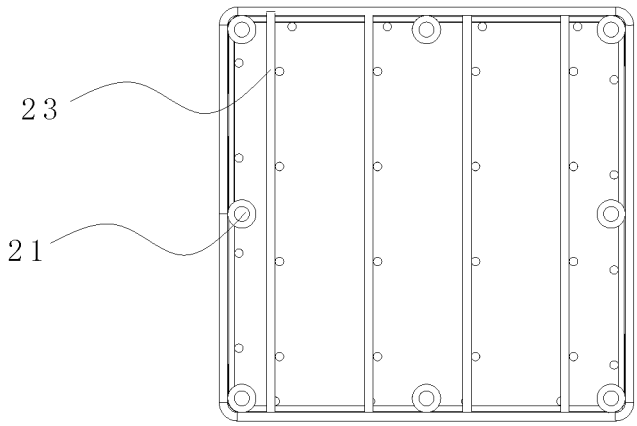
FIG. 51 is an end view of the rigid skeleton shown in FIG. 50.

Referring to FIG. 50 and FIG. 51, FIG. 50 is a schematic structural view of the rigid skeleton of the variable cross-section prefabricated square pile disclosed in the seventeenth embodiment of the present disclosure; and FIG. 51 is an end view of the rigid skeleton shown in FIG. 50.

In this embodiment, the same reference numerals represent the same parts with those in the fifteenth embodiment, and the same descriptions to which are omitted.

Compared with the fifteenth embodiment, the difference of this embodiment is: the plane where the rigid meshes 23 are located is parallel to the central axis of the axial reinforcement 26-2. The rigid meshes 23 are arranged on the rigid mesh enclosure 26 in sequence parallel to the axial reinforcement 26-2, and the reserved cavity is divided into several small spaces in the width direction or height direction, so that the concrete at the end of the concrete prefabricated pile can be more compact.

Preferably, the connection form of the rigid mesh 23 on the rigid mesh enclosure 26 can be such that two opposite ends of the rigid mesh 23 are connected to the rigid mesh enclosure 26.

Figure 52:
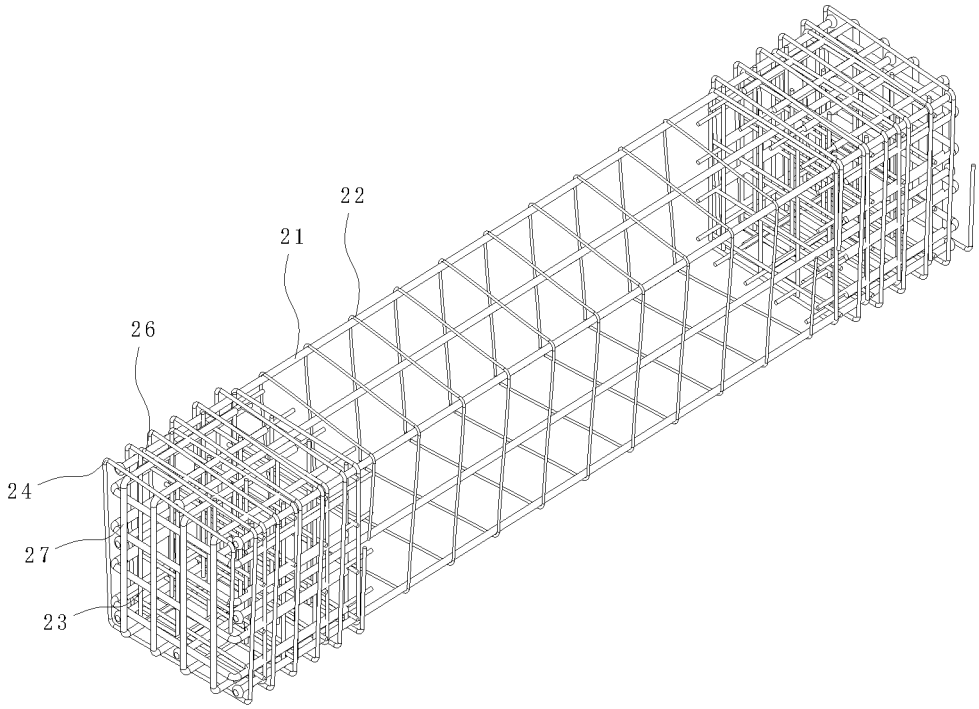
FIG. 52 is a schematic structural view of the rigid skeleton of the variable cross-section prefabricated square pile disclosed in the eighteenth embodiment of the present disclosure.
Figure 53:
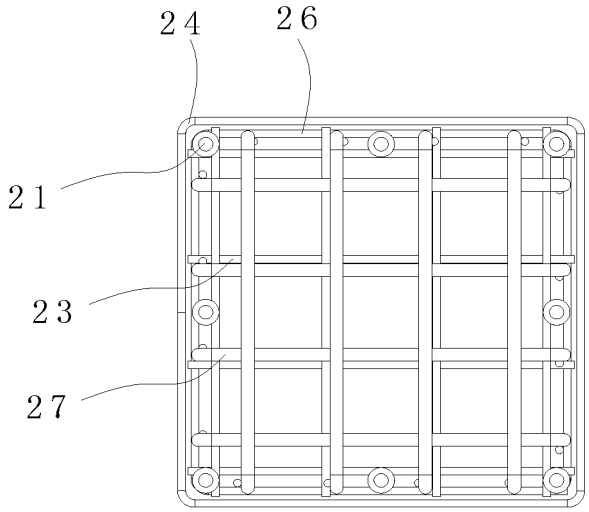
FIG. 53 is an end view of the rigid skeleton shown in FIG. 52.
Figure 57:
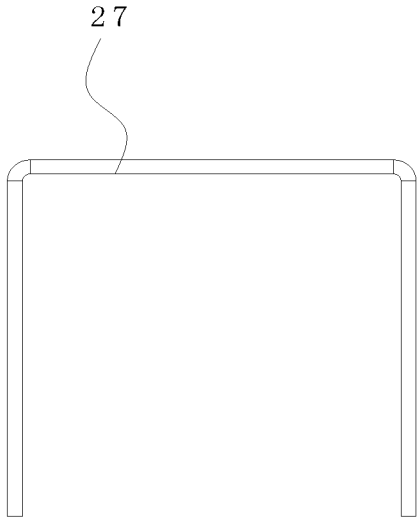
FIG. 57 is a schematic structural view of a C-type ferrule.

Referring to FIG. 52, FIG. 53 and FIG. 57, FIG. 52 is a schematic structural view of the rigid skeleton of the variable cross-section prefabricated square pile disclosed in the eighteenth embodiment of the present disclosure; FIG. 53 is an end view of the rigid skeleton shown in FIG. 52; and FIG. 57 is a schematic structural view of a C-type ferrule.

In this embodiment, the same reference numerals represent the same parts with those in the fifteenth embodiment, and the same descriptions to which are omitted.

Compared with the fifteenth embodiment, the difference of this embodiment is in that: several C-shaped ferrules 27 are further provided on the end face of the main reinforcement skeleton, and the opening of the C-shaped ferrules 27 faces the middle section of the reserved cavity.

In the above structure, the C-shaped ferrule 27 can form a blocking surface at the end of the main reinforcement skeleton, so that the end structure of the main reinforcement skeleton is more stable, and the structural strength of the end surface of the concrete prefabricated pile is strengthened.

Specifically, the C-shaped ferrules 7 are uniformly arranged in the reserved cavity of the main reinforcement skeleton in the horizontal or vertical direction; or the C-shaped ferrules 7 are arranged crosswise in the reserved cavity of the main reinforcement skeleton; the C-shaped ferrules 7 are fixedly connected with the auxiliary stirrup 24 or/and the rigid mesh enclosure 26. The C-shaped ferrules 27 adopt the above arrangement to form a blocking surface, which can enhance the structural strength of the end face of the concrete prefabricated pile and can fasten the rigid mesh enclosure 26 together with the auxiliary stirrups 24. Preferably, the C-shaped ferrules 27 are arranged crosswise on the end face of the main reinforcement skeleton. Of course, the end of the rigid meshes 23 in the fifteenth embodiment may also be connected with the C-shaped ferrules 27.

Preferably, the end of the rigid meshes 23 are fixedly connected with the rigid mesh enclosure 26, the C-shaped ferrules 27 are fixedly connected with the end of the rigid mesh enclosure 26, and the C-shaped ferrules 27 are located inside the rigid mesh enclosure 26. The rigid meshes 23 can be connected to the C-shaped ferrules 27, then connected to the rigid mesh enclosure 26 to form an integrated structure, and then ferruled on the end of the main reinforcement skeleton, which facilitates the placement of the rigid mesh 23.

The working principle of this embodiment is in that: during prefabrication, the main reinforcement 21 is ferruled with the skeleton stirrup 22 to form the main reinforcement skeleton, and the C-shaped ferrule 7 is connected to the end of the rigid mesh enclosure 26 to form a blocking surface. Then the rigid mesh 23 is connected to the rigid mesh enclosure 26, the rigid mesh enclosure 26 is bound on the end of the main reinforcement skeleton, and finally the rigid mesh enclosure 26 and the main reinforcement 21 are ferruled by the auxiliary stirrups 24. It may prevent the main reinforcement 21 at the end of the main reinforcement skeleton from being blasted by pumping concrete when making concrete prefabricated piles. It may also prevent the rigid mesh from being impacted by the pumped concrete, getting out of the reserved cavity of the main reinforcement skeleton, and protect the end structure of the main reinforcement skeleton, and make the main reinforcement skeleton structure more stable. In addition, the concrete at the end of the concrete prefabricated pile can be made more compact, thereby enhancing the structural strength and anti-peening ability of the end part of the concrete prefabricated pile.

On the basis of the above embodiment, on the cross section of the small-section segment 2, the cross section area of the small-section segment 2 is S1, and the sum of the cross section areas of the steel bars is S2. The ratio of S2 to S1 is at least 0.5% to 0.15%, and the proportion of stressed stiffener is high, which improves the structural strength and pull-out strength of the pile body. In addition, the length of the spiral stirrup dense zone at both ends of the pile is longer than the length of the large-section segment 3 at the end, and the density of the spiral stirrup dense zone at both ends of the pile is 1.5-3 times that of the regular zone, so as to improve the structural strength and anti-beating performance of the pile end; the interval between the steel bars is greater than or equal to 50 mm, so that the coarse aggregate (i.e., stones) can be evenly distributed when pouring or pumping concrete; a rigid mesh enclosure 26 and a rigid mesh 23 are provided at the end of the pile so as to improve the peening resistance of the pile end, and prevent the connection pieces or stressed stiffeners from being exposed to underground acid and alkali corrosive substances caused by pile blast.

In a case that the lateral transition surface 4 is a concave surface or a convex surface, the traces of its front edge or rear edge may not be very obvious due to the smooth transition, and it can be difficult to distinguish it by human eyes. Regard this, auxiliary lines can be made along the boundary of the lateral transition surface 4 to define the position of its front edge or rear edge.

The variable cross-section prefabricated square piles claimed in the present disclosure include variable cross-section solid square piles and variable cross-section hollow square piles. For the solid square pile with variable cross-section, either the U-shaped die or the closed die being opened and closed along the diagonal can be used for production. When the U-shaped die is used for production, the present disclosure will be very beneficial in demoulding, and may avoid cracking or the risk of falling off of concrete protective layer caused by violent demoulding.

The technical solutions between the various embodiments can be combined with each other, but should be based on the realization by those of ordinary skill in the art. If the combination of technical solutions contradicts each other or cannot be realized, it should be considered that such combination of technical solutions does not exist and does not fall within the protection scope of the present application.

The concrete variable cross-section prefabricated square pile provided by the present application has been described in detail above. The principle and the embodiments of the present application are illustrated herein by specific examples. The above description of examples is only intended to help the understanding of the idea of the present application. It should be noted that, for the person skilled in the art, many modifications and improvements may be made to the present application without departing from the principle of the present application, and these modifications and improvements are also deemed to fall into the protection scope of the present application defined by the claims.

The invention claimed is:

1. A concrete variable cross-section prefabricated pile, comprising a pile body with large-section segments and small-section segments alternately arranged in a longitudinal direction, wherein a top surface and a bottom surface of the pile body are flat, the large-section segments and the small-section segments are integrally formed, and a cross-section of each of the large-section segments and a cross section of each of the small-section segments are substantially rectangular; wherein a lateral transition surface is formed between a side surface of the large-section segment and a side surface of one of the small-section segments which is adjacent to the large-section segment; wherein at least a part of the lateral transition surfaces have front edges and/or rear edges, lateral projections of the front edges and/or rear edges are deviated from the vertical direction, and a vertical projection of an intersection line between the lateral transition surface and a first horizontal plane is located outside a vertical projection of an intersection line between the lateral transition surface and a second horizontal plane, wherein the second horizontal plane is lower than the first horizontal plane; wherein one or both side surfaces of the small-section segment are perpendicular to the bottom surface of the small-section segment or are inclined to the inside of the pile body from top to bottom at a set angle.

2. The concrete variable cross-section prefabricated pile according to claim 1, wherein the front edge and/or the rear edge of the lateral transition surface deviating from the vertical direction in lateral projection is an inclined edge or a curved edge.

3. The concrete variable cross-section prefabricated pile according to claim 1, wherein a front edge and a rear edge of the side surface of the large-section segment between the two ends are vertical edges, and a surface width thereof remains constant from top to bottom; or the front edge and/or the rear edge of the side surface of the large-section segment between the two ends are deviated from the vertical direction in the lateral projection, and its surface width increases or decreases from top to bottom.

4. The concrete variable cross-section prefabricated pile according to claim 1, wherein the lateral transition surface comprises a first transition surface located at the front of the small-section segment and a second transition surface located at the rear of the small-section segment, a rear edge of the first transition surface is inclined or curved forward from top to bottom; and/or a front edge of the second transition surface is inclined or curved backward from top to bottom.

5. The concrete variable cross-section prefabricated pile according to claim 1, wherein the lateral transition surface comprises a first transition surface located at the front of the small-section segment and a second transition surface located at the rear of the small-section segment, a front edge of the first transition surface is inclined or curved forward from top to bottom; and/or a rear edge of the second transition surface is inclined or curved backward from top to bottom.

6. The concrete variable cross-section prefabricated pile according to claim 1, wherein the lateral transition surface is a plane, a front edge of the lateral transition surface is parallel to a rear edge of the lateral transition surface, and the surface width remains constant from top to bottom; or the lateral transition surface is a plane, the front edge and rear edge of the lateral transition surface are not parallel, and the surface width increases or decreases from top to bottom; or the lateral transition surface is a curved surface, the front edge of the lateral transition surface is parallel to the rear edge of the lateral transition surface, and the surface width remains constant from top to bottom; or the lateral transition surface is a curved surface, the front edge and rear edge of the lateral transition surface are not parallel, and the surface width increases or decreases from top to bottom.

7. The concrete variable cross-section prefabricated pile according to claim 6, wherein the lateral transition surface is a concave curved surface, a convex curved surface or a twisted surface.

8. The concrete variable cross-section prefabricated pile according to claim 7, wherein the concave curved surface comprises a concave arc surface or a concave conical surface, and the convex curved surface comprises a convex arc surface or a convex conical surface.

9. The concrete variable cross-section prefabricated pile according to claim 1, wherein an extension line of a vertical projection of an intersection line between the lateral transition surface and the first horizontal plane intersects with an extension line of the vertical projection of an intersection line between the lateral transition surface and the second horizontal plane.

10. The concrete variable cross-section prefabricated pile according to claim 1, wherein the pile body has pile end faces, at least one pile end face has a groove and a plurality of connecting holes being arranged at intervals; wherein the groove is configured to at least partially accommodate a storage block in which a viscous substance is stored, a depth of the groove is less than an initial height of the storage block; wherein when the prefabricated square piles are butted together, the storage block is compressed so as to release the viscous substance to eliminate and/or fill the gaps at the end faces of the butted prefabricated square piles.

11. The concrete variable cross-section prefabricated pile according to claim 10, wherein a groove depth of the accommodating groove is greater than or equal to 1 mm, a groove width of the accommodating is greater than or equal to 1 mm, and the accommodating groove is more than 0.5 cm away from the connecting hole.

12. The concrete variable cross-section prefabricated pile according to claim 11, wherein a groove depth of the accommodating groove is 2 mm-20 mm.

13. The concrete variable cross-section prefabricated pile according to claim 10, wherein at least one of the grooves is circular or annular or rectangular or regular polygon and located at the center of the pile end face;

and/or, at least one of the grooves is annular and surrounds all connecting holes;

and/or, at least one of the grooves is annular and surrounds part of the connecting holes;

and/or, at least one of the grooves is annular and surrounds a single connecting hole.

14. The concrete variable cross-section prefabricated pile according to claim 10, wherein a rigid skeleton of the concrete variable cross-section prefabricated pile comprises: a main reinforcement skeleton with a plurality of main reinforcements being arranged at intervals and wound to form a reserved cavity, and a skeleton stirrup which ferrules the main reinforcement skeleton;

wherein the ends of the main reinforcement skeletons are bound with rigid mesh enclosures and/or rigid meshes to enhance the structural strength of the prefabricated piles, the ends of the main reinforcement skeleton are ferruled and fixed by auxiliary stirrups, and a winding interval of the auxiliary stirrups is less than or equal to a winding interval of the skeleton stirrups.

15. The concrete variable cross-section prefabricated pile according to claim 14, wherein the auxiliary stirrups form a stirrup dense zone, and a length of the stirrup dense zone is greater than a length of the large-section segment at the end; wherein a winding density of the stirrup dense zone is 1.5-3 times than a winding density of the non-dense zone.

16. The concrete variable cross-section prefabricated pile according to claim 14, wherein a plurality of C-shaped ferrules with openings facing the middle of the reserved cavity are further provided at the end faces of the main reinforcement skeleton.

17. The concrete variable cross-section prefabricated pile according to claim 16, wherein the C-shaped ferrules are arranged at intervals in the reserved cavities of the main reinforcement skeleton in sequence in the transverse or longitudinal direction; and/or the C-shaped ferrules are arranged crosswise in the reserved cavity of the main reinforcement skeleton; wherein the C-shaped ferrules are fixedly connected with the auxiliary stirrup or/and the rigid mesh enclosure.

18. The concrete variable cross-section prefabricated pile according to claim 14, wherein connecting nuts are connected to the end of the main reinforcement, and the auxiliary stirrup is connected and fixed with at least one of the connecting nuts.

19. The concrete variable cross-section prefabricated pile according to claim 14, wherein the auxiliary stirrup and the rigid mesh enclosure are connected and fixed, and the rigid mesh enclosure is located inside the auxiliary stirrup;

or the rigid mesh enclosure includes a plurality of annular reinforcements arranged in sequence along the length of the main reinforcement skeleton at intervals and a plurality of axial reinforcements for connecting and fixing the annular reinforcements; wherein the axial reinforcements are parallel to the main reinforcements;

or the rigid meshes are arranged at the ends of the main reinforcement skeleton and arranged at intervals along the length direction of the reserved cavity.

20. The concrete variable cross-section prefabricated pile according to claim 14, wherein a length of the large-section segment at both ends of the pile body is greater than a length of the large-section segment in the middle part, the length of the large-section segment at both ends of the pile body is about 2 to 6 times the length of the large-section segment in the middle part;

and/or on the cross section of the small-section segment, a cross-sectional area of the small-section segment is S1, the sum of the cross-sectional areas of the steel bars is S2, wherein a ratio of S2 to S1 is at least 0.5% to 0.15%.

* * * * *